US008690045B2

(12) United States Patent
Jang

(10) Patent No.: US 8,690,045 B2
(45) Date of Patent: Apr. 8, 2014

(54) SPREADABLE BOX

(76) Inventor: Jae Hyuck Jang, Potomac, MD (US)

( * ) Notice: Subject to any disclaimer, the term of this patent is extended or adjusted under 35 U.S.C. 154(b) by 343 days.

(21) Appl. No.: 13/041,646

(22) Filed: Mar. 7, 2011

(65) Prior Publication Data

US 2012/0228371 A1 Sep. 13, 2012

(51) Int. Cl.
*B65D 5/355* (2006.01)
*B65D 5/30* (2006.01)

(52) U.S. Cl.
USPC ..... 229/123; 229/122.23; 229/122.32; 229/122.34; 229/101; 229/110

(58) Field of Classification Search
USPC ..... 229/122.23, 122.32, 122.34, 108, 110, 229/198, 116.1, 101, 123, 108.1; 446/5, 446/488; 428/12
See application file for complete search history.

(56) References Cited

U.S. PATENT DOCUMENTS

| | | | | |
|---|---|---|---|---|
| 1,675,314 | A * | 6/1928 | Rosenfield et al. | 229/125.19 |
| 1,906,622 | A * | 5/1933 | Kondolf | 229/122.34 |
| 2,105,953 | A * | 1/1938 | Ouellette | 229/101 |
| 2,663,487 | A * | 12/1953 | Paige | 206/45.29 |
| 2,793,802 | A * | 5/1957 | Scaturro | 206/45.29 |
| 3,010,635 | A * | 11/1961 | Sheldon-Williams | 229/169 |
| 3,373,923 | A * | 3/1968 | Martelli | 229/123 |
| 4,295,599 | A * | 10/1981 | Locatelli et al. | 206/737 |
| 4,317,536 | A | 3/1982 | Dickerson | |
| 7,044,359 | B1 * | 5/2006 | Cohen | 229/122.34 |
| 2005/0092821 | A1 * | 5/2005 | Mazurek | 229/122.34 |
| 2010/0294831 | A1 * | 11/2010 | Hallam | 229/122.32 |

FOREIGN PATENT DOCUMENTS

| | | |
|---|---|---|
| JP | 53-33531 | 3/1978 |
| JP | 55-30260 | 2/1980 |
| JP | 6-10115 | 2/1994 |
| JP | 6-39718 | 5/1994 |
| JP | 3008807 | 3/1995 |
| KR | 20-1998-0017647 U | 7/1998 |
| KR | 20-0302042 | 1/2003 |
| KR | 10-2008-0044414 A | 5/2008 |
| KR | 10-2009-0022919 | 3/2009 |
| KR | 20-2009-0010475 | 10/2009 |
| KR | 10-2010-0057386 A | 5/2010 |
| KR | 20-2010-0012951 U | 12/2010 |

OTHER PUBLICATIONS

Korean Office Action mailed from KIPO on May 22, 2012 for Korean Patent Application No. 10-2011-0117179, citing the above reference(s).

(Continued)

*Primary Examiner* — Gary Elkins
*Assistant Examiner* — Scott McNurlen
(74) *Attorney, Agent, or Firm* — Lowe Hauptman & Ham, LLP

(57) ABSTRACT

A spreadable box includes a bottom portion, a plurality of sidewall portions, and at least one support tab. The plurality of sidewall portions is extended from the bottom portion. The at least one of the plurality of sidewall portions includes a pair of sidewall planes folded to overlie each other with a space there between. The at least one support tab is protruded from at least one of the plurality of sidewall portions and configured to be inserted into or withdrawn from the space in order to secure the box in an assembled form or a spread form.

5 Claims, 39 Drawing Sheets

(56) References Cited

OTHER PUBLICATIONS

Korean Office Action mailed from KIPO on Nov. 23, 2012 for Korean Patent Application No. 10-2011-0117179, citing the above reference(s).

Decision of Preferential Examination mailed from KIPO on Mar. 23, 2012 for Korean Patent Application No. 10-2011-0117179, citing the above references.

Notification concerning Transmittal of International preliminary Report on Patentability of the international searching authority for PCT/US2012/026906 dated Sep. 19, 2013.

* cited by examiner

SPREADABLE BOX

TECHNICAL FIELD

The disclosure relates to spreadable boxes.

BACKGROUND

Typical boxes are sized to securely accommodate an entire product or an article in order to prevent the contents of the box from damage by shaking or impact which might be caused by vacant space in the box. Therefore, general boxes have a narrow space, and it is difficult to put in articles or take out articles from the box in a simple and easy way when there is a tight fit. Furthermore, disposable products are most commonly used as a box for packaging food products or articles. Particularly, in case of boxes for convenience foods such as hamburgers or pizzas, the boxes are discarded without any recycling. For example, in case of pizza slices, the boxes can't be used as plates. Instead, additional dinner plates are necessary in order to serve the pizza slices to people. As consumer's preferences have been highly diversified, it is desirable to provide a box that overcomes the above-described problems and disadvantages in order to meet an increasing desire or convenience of consumers.

SUMMARY

A spreadable box includes a bottom portion, a plurality of sidewall portions, and at least one support tab. The bottom portion includes at least one bottom plane. The plurality of sidewall portions are extended from the bottom portion. At least one of the sidewall portions includes a pair of sidewall planes folded to overlie each other with a space therebetween. The support tab is protruded from at least one of the plurality of sidewall portions and configured to be inserted into or withdrawn from the space in order to secure the box in an assembled form or a spread form.

According to some embodiments, the at least one bottom plane may include a first bottom plane integrally formed with the plurality of sidewall portions. Additionally, the support tab may be protruded from each of the sidewall portions. Each of the plurality of the sidewall portions may include a pair of sidewall planes folded to overlie each other with the space therebetween, and the at least one support tab includes a plurality of one-side support tabs each of which is protruded from one edge of the pair of sidewall planes and configured to be inserted into or withdrawn from the space in order to secure the box in an assembled form or a spread form.

According to some embodiments, the at least one bottom plane may include a first bottom plane and a second bottom plane overlain one of the first or second bottom planes overlying the other of the first or second bottom planes. The plurality of sidewall portions may include a plurality of first sidewall portions extending from the first bottom plane, and a plurality of second sidewall portions extending from the second bottom plane. Each of the plurality of first sidewall portions may include the pair of sidewall planes folded to overlie each other with the space therebetween. And, the at least one support tab may include a plurality of support tabs each of which is protruded from each edge of the plurality of second sidewall portions. The plurality of support tabs may include a first support tab and a second support tab protruded from one of the plurality of second sidewall portions in opposite directions to each other. Alternatively, the plurality of support tabs may include a plurality of one-side support tabs each of which is protruded from each edge of the plurality of second sidewall portions and configured to be inserted into or withdrawn from the space formed by the pair of the sidewall plane of the plurality of first sidewall portions in order to secure the box in an assembled form or a spread form.

According to some embodiments, the pair of sidewall planes may include an inner sidewall plane connected to the bottom portion and having a first length along the longitudinal direction of the sidewall portion, and an outer sidewall plane connected to an edge of the inner sidewall plane on the opposite side of the bottom portion and having a second length greater than the first length along the longitudinal direction of the sidewall portion.

According to some embodiments, the at least one support tab may have a break portion configured to control a withdrawal distance of the support tab from the space formed by the pair of the sidewall planes. According to some embodiments, the support tab may have a fan shape having a curved edge for providing a rounded outermost edge of the box in the spread form.

According to some embodiments, the box may further includes a plurality of support tabs including the at least one of support tab, and a connection positioned within the space formed by the pair of the sidewall planes for connecting neighboring two support tabs selected from the plurality of support tabs through the space, the neighboring two support tabs being inserted into or withdrawn from the space.

According to some embodiments, the box includes a bottom portion including at least one bottom plane, and a plurality of sidewall means for forming a space between a pair of sidewall planes folded to overlie each other. At least one of the plurality of sidewall means includes the pair of sidewall planes. The plurality of sidewall means extend from the bottom portion. The box further includes at least one of supporting means for securing the box in an assembled form or a spread form by being inserted into or withdrawn from the space. The at least one of supporting means is protruded from at least one of the plurality of sidewall means.

According to some embodiments, the box may further includes an inner liner covering the bottom portion and the plurality of sidewall portions for preventing leakage from an inside of the box, and having at lease one ruffled portion facing with the at least one support tab when the box is in a spread form.

BRIEF DESCRIPTION OF THE DRAWINGS

Reference is now made to the following descriptions taken in conjunction with the accompanying drawings, in which.

DETAILED DESCRIPTION

Figure 1A:
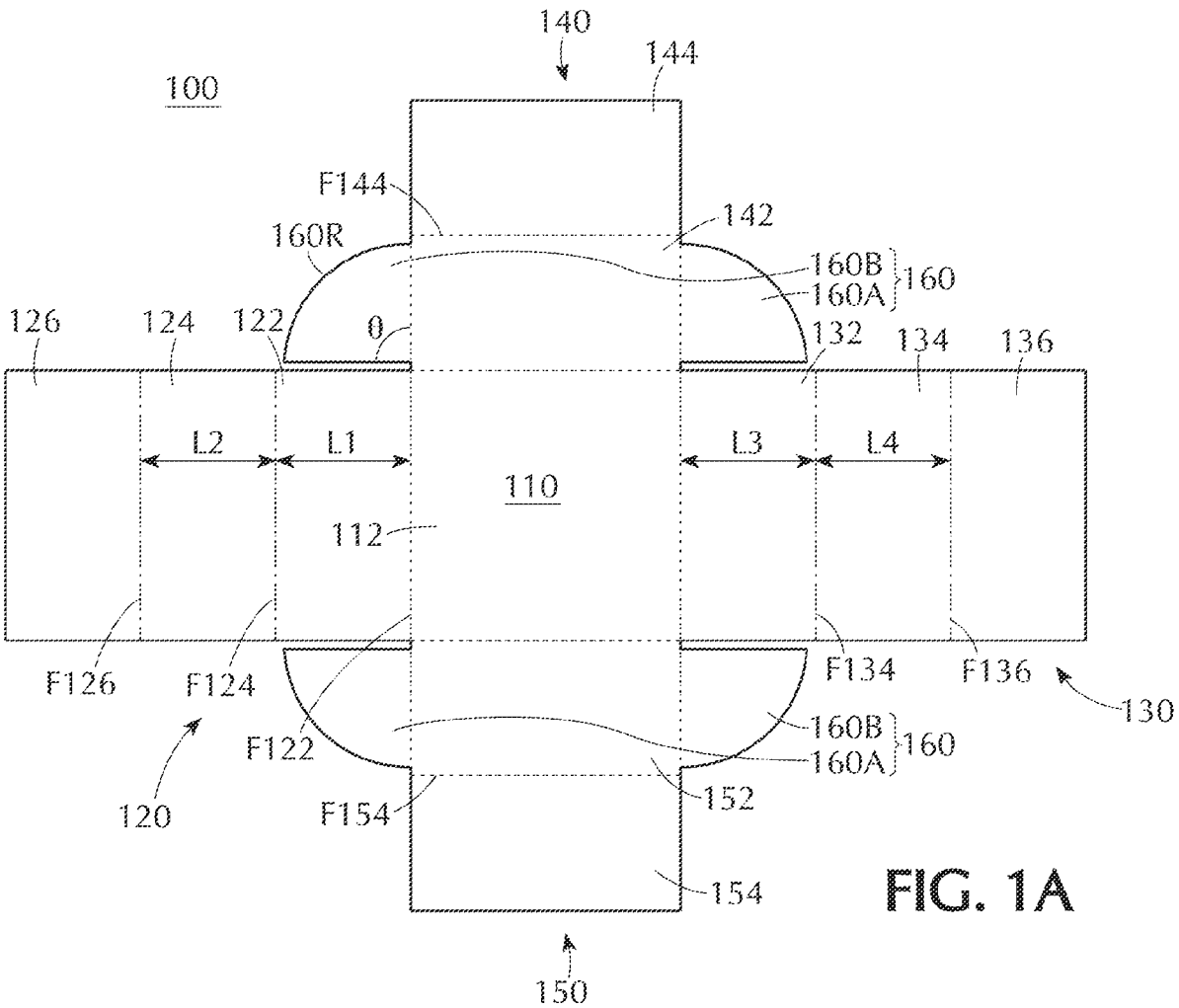
FIG. 1A is a top view of an exemplary box expanded out according to some embodiments.

The making and using of various embodiments are discussed in detail below with reference to the accompanying drawings, in which exemplary embodiments of the inventive concept are shown. The inventive concept may, however, be embodied in many different forms and should not be construed as being limited to the embodiments set forth herein; rather, these embodiments are provided so that this description will be thorough and complete, and will fully convey the inventive concept to those of ordinary skill in the art. It will be apparent, however, that one or more embodiments may be practiced without these specific details. In the drawings, the thicknesses and widths of layers and regions are exaggerated for clarity. Like reference numerals in the drawings denote like elements. The elements and regions illustrated in the figures are schematic in nature, and thus relative sizes or intervals illustrated in the figures are not intended to limit the scope of the inventive concept. In the drawings, dotted lines represent inward folding lines for folding up in the top views of the drawings, and alternate long and short dash lines represent outward folding lines for folding down in the top views of the drawings. The inward folding lines and the outward folding lines may include indentations, miscellaneous cuts, through-cut slits, or perforations formed along the folding lines.

Referring to FIG. 1A, a box 100 is expanded in a blank form useful for forming a spreadable box according to some embodiments. The box 100 includes a bottom portion 110, a plurality of sidewall portions 120, 130, 140 and 150, and a plurality of support tabs 160, and all of which are integrally connected to form the box 100. The box 100 may be formed from paper, corrugated cardboard, plastic, wood or combinations thereof.

In some embodiments, the bottom portion 110 has a rectangular shape. However, it is apparent that various changes may be made to the shape of the bottom portion 110. The plurality of sidewall portions 120, 130, 140 and 150 are extended from the bottom portion 110. The sidewall portion 120 includes a pair of sidewall planes 122 and 124 foldable to overlie each other with a space S1 therebetween (see FIGS. 2A through 2D). And, the sidewall portion 130 includes a pair of sidewall planes 132 and 134 foldable to overlie each other with a space S2 therebetween (see FIGS. 2A through 2D).

According to some embodiments, the sidewall portion 120 further has a fixing plane 126 connected to an edge of the second sidewall plane 124. The fixing plane 126 is foldable to overlie the bottom portion 110. And, the sidewall portion 130 further has a fixing plane 136 connected to an edge of the second sidewall plane 134. The fixing plane 136 is foldable to overlie the bottom portion 110. Backsides of the fixing planes 126 and 136 may be fixed or adhered to a backside of the bottom portion 110, respectively, using a fixing means such as adhesive paste material or an adhesive tape.

In the pair of sidewall planes 122 and 124, an inner sidewall plane 122 is connected to the bottom portion 110 and has a first length L1 along the longitudinal direction of the sidewall portion 120, and an outer sidewall plane 124 is connected to an edge of the inner sidewall plane 122 on the opposite side of the bottom portion 110 and has a second length L2 substantially equal to the first length L1 along the longitudinal direction of the sidewall portion 120. In the pair of sidewall planes 132 and 134, an inner sidewall plane 132 is connected to the bottom portion 110 and has a third length L3 along the longitudinal direction of the sidewall portion 130, and an outer sidewall plane 134 is connected to an edge of the inner sidewall plane 132 on the opposite side of the bottom portion 110 and has a fourth length L4 substantially equal to the third length L3 along the longitudinal direction of the sidewall portion 120. The first length L1 and the third length L3 may be equal to each other, and the second length L2 and the fourth length L4 may be equal to each other.

Each of the plurality of support tabs 160 are protruded from a portion of each of the plurality of sidewall portions 140 and 150. Each of the plurality of support tabs 160 are configured to be inserted into the space S1 formed by the pair of sidewall planes 122 and 124 and the space S2 formed by the pair of sidewall planes 132 and 134 in order to secure the box 100 in an assembled form (see FIGS. 2E through 2H). And, each of the plurality of support tabs 160 are configured to be withdrawn from the space S1 formed by the pair of sidewall planes 122 and 124 and the space S2 formed by the pair of sidewall planes 132 and 134 in order to secure the box 100 in a spread form (see FIG. 3).

According to some embodiments, each of the plurality of support tabs 160 has a fan shape a central angle θ. The plurality of support tabs 160 having a curved edge 160R provides a rounded outermost edge of the box 100 when the box 100 is in its spread form. The central angle θ may be selected from a wide range of angles as required. For example, the central angle θ may have an acute angle, right angle, or an obtuse angle.

According to some embodiments, the plurality of support tabs 160 includes a first support tab 160A and a second support tab 160B protruded from both side of the sidewall portions 140 and 150 in opposite directions to each other, as shown in FIG. 1A. According to some embodiments, the support tabs 160 are protruded from opposite sides of each of the sidewall portions 140 or 150 when the bottom portion 110 has a polygon shape having even number of sides, while the support tabs 160 are protruded from one side of each of the sidewall portions 140 and 150 when the bottom portion 110 has a polygon shape having odd number of sides. According to some embodiments, the bottom portion 110 includes a first bottom plane 112 integrally formed with the plurality of sidewall portions 120, 130, 140 and 150.

According to some embodiments, the pair of sidewall planes 122 and 124 of the sidewall portions 120 are folded down along a folding line F124 to overlie each other with the space S1 therebetween, and the pair of sidewall planes 132 and 134 of the sidewall portions 130 may be folded down along a folding line F134 to overlie each other with the space S2 therebetween.

The sidewall portions 140 and 150 include first sidewall planes 142 and 152 and cover planes 144 and 154, respectively. According to some embodiments, the cover planes 144 and 154 are located at end parts of the sidewall portions 140 and 150. The cover planes 144 and 154 are foldable up and down along a folding lines F144 and F154, respectively, in order to close or open the box 100 when the box 100 is in an assembled form (see FIGS. 2F through 2G).

The cover planes 144 and 154 are illustrated in FIG. 1 to have a rectangular shape. However, the shapes of the cover planes 144 and 154 are not limited thereto. The cover planes 144 and 154 may have various shapes as required.

According to some embodiments, the second length L2 of the outer sidewall plane 124 may be greater than the first length L1 of the inner sidewall plane 122 and the fourth length L4 of outer sidewall plane 134 may be greater than the third length L3 of the inner sidewall 132. In this case, the outer sidewall plane 124 becomes an arch while the inner sidewall 122 is maintained its planar form, when the inner sidewall plane 122 and the outer sidewall 124 are folded along the folding line F124 to overlie each other and the fixing plane 126 is folded along a folding line F126 to overlie the bottom portion 110 in a state where the folding line F126 and a folding line F122 meet each other in order to secure the box 100 in an assembled form. Similarly, the outer sidewall plane 134 becomes an arch while the inner sidewall plane 132 is maintained its planar form, when the inner sidewall plane 132 and the outer sidewall 134 are folded along the folding line F134 to overlie each other and the fixing plane 136 is folded along a folding line F136 to overlie the bottom portion 110 in a state where the folding line F136 and a folding line F132 meet each other in order to secure the box 100 in an assembled form. As a result, it is possible to prevent entire of each of the support tabs 160 from being withdrawn from spaces formed between the pair of sidewall planes 122 and 124 and the pair of sidewall planes 132 and 134, respectively, by virtue of the arched outer sidewall planes 124 and 134. Therefore, the box 100 is converted into a dish type container when the box 100 is in a spread form.

Figure 1B:
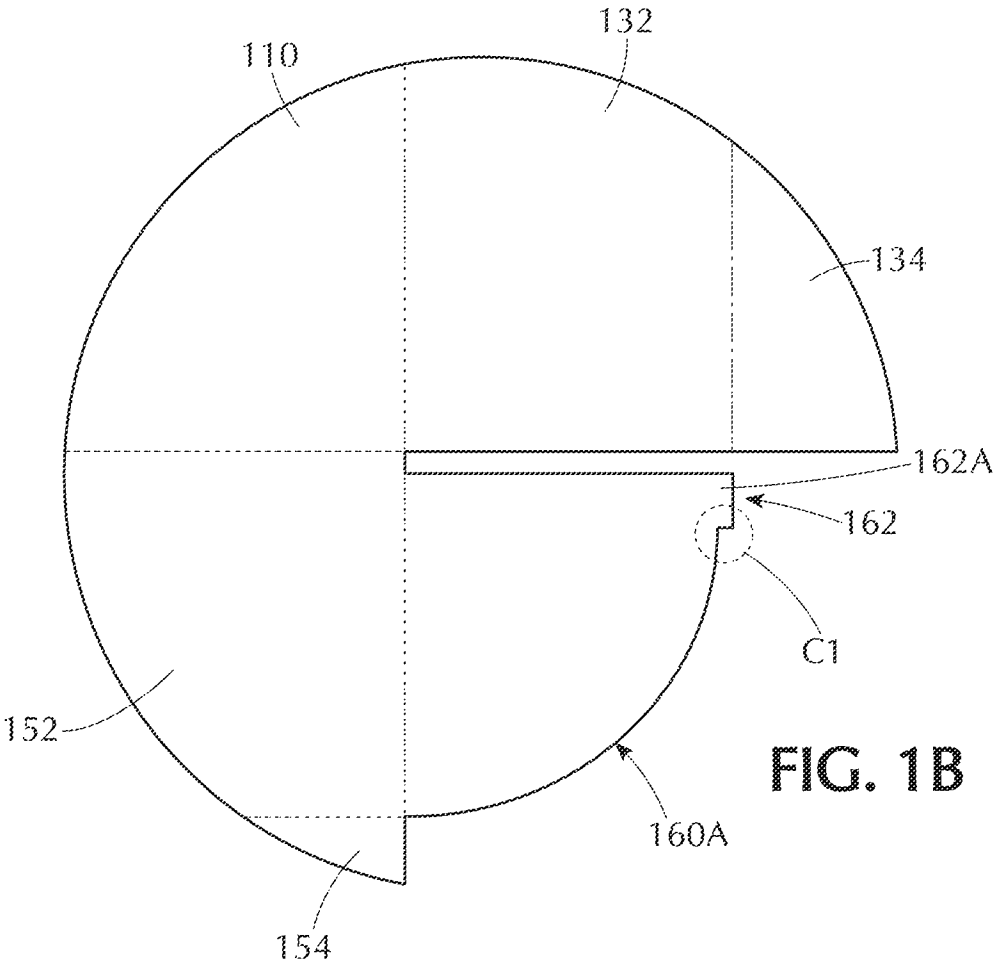
FIG. 1B through 1E are partial top views showing alternative examples of the box according to some embodiments.

FIG. 1B is a partial top view showing an exemplary support tab 160A according to some embodiments. The box 100 in FIG. 1A may adopt one or more of the support tab 160A instead of the support tabs 160.

In FIG. 1B, the support tab 160A has a break portion 162 configured to control a withdrawal distance of the support tab 160A from the space S1 formed by the pair of the sidewall planes 122 and 124 or the space S2 formed by the pair of the sidewall planes 132 and 134. The break portion 162 includes a bump 162A protruded from a part of the support tab 160A. The bump 162A causes friction with the pair of sidewall planes 122 and 124 or the pair of sidewall planes 132 and 134 within the space S1 or S2 formed by the pair of sidewall planes 122 and 124 or the pair of sidewall planes 132 and 134 when the support tab 160A is withdrawn from the space S1 or S2. According to some embodiments, the bump 162A of the support tab 160A has a pointed part forming a right angle, as shown within a circle C1. The pointed part of the bump 162A may cause friction with the pair of sidewall planes 122 and 124 or the pair of sidewall planes 132 and 134 within the space S1 or S2 formed by the pair of sidewall planes 122 and 124 or the pair of sidewall planes 132 and 134 when the support tab 160A is withdrawn from the space S1 or S2. According to some embodiments, the break portion 162 is protruded from a portion of the support tab 160A in close proximity to the pair of sidewall planes 122 and 124 or the pair of sidewall planes 132 and 134. The friction between the break portion 162 and the pair of sidewall planes 122 and 124 or the pair of sidewall planes 132 and 134 may prevent entire of the support tab 160A from being withdrawn from the space S1 or S2. As a result, the box 100 may be converted into a bowl type container when the box 100 is in a spread form.

Figure 1C:
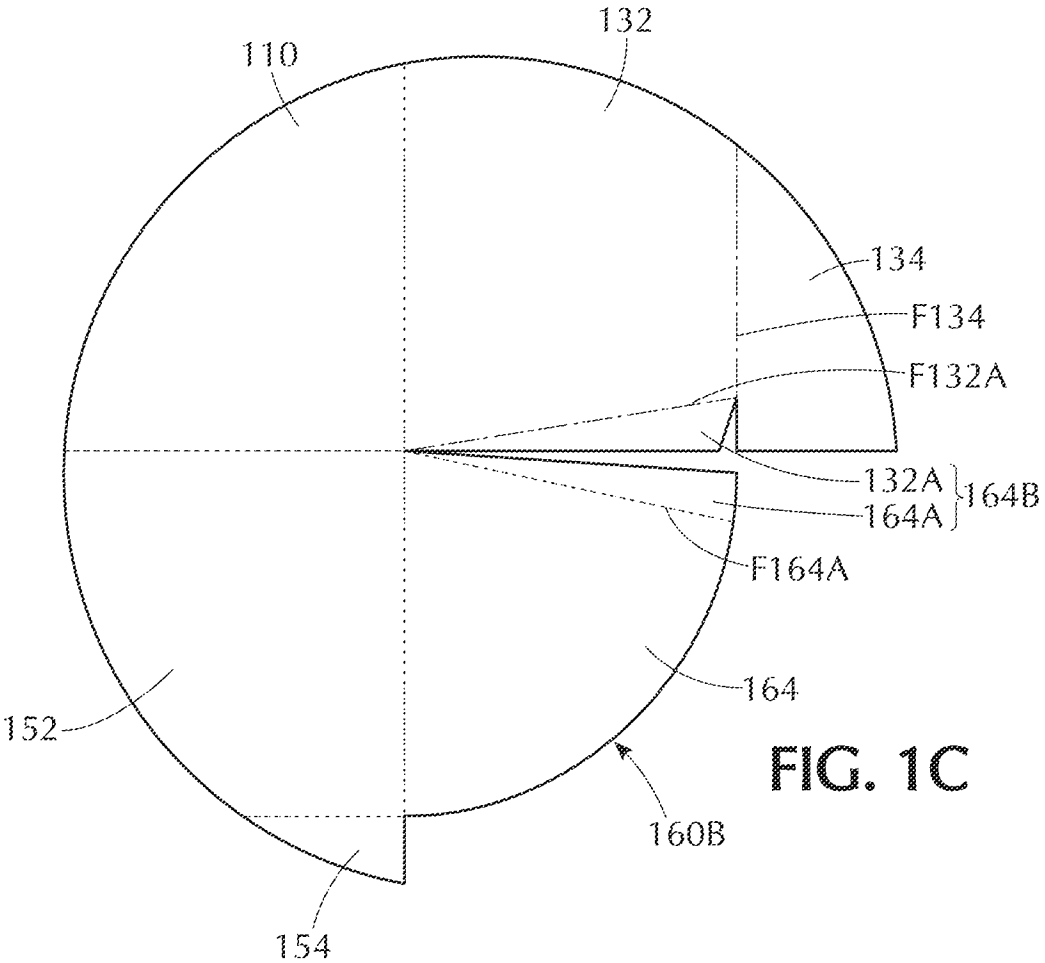

FIG. 1C is a partial top view showing an exemplary support tab 160B according to some embodiments. The box 100 in FIG. 1A may adopt one or more of the support tab 160B instead of the support tabs 160.

The support tab 160B has a main surface 164 connected to and extended from the first sidewall plane 152 of the sidewall portion 150 or the first sidewall plane 142 of the sidewall portion 140, and a first sloped surface 164A connected to and extended from an edge of the main surface 164. The edge of the main surface 164 acts as a folding line F164A between the main surface 164 and the first sloped surface 164A. The first sloped surface 164A is folded up along the folding line F164A so that the first sloped surface 164A is extended in a nonparallel direction to the main surface 164. The folded first sloped surface 164A forms a portion of a bump 164B by cooperating with a second sloped surface 132A included in the sidewall portion 130.

The second sloped surface 132A is connected to and extended from an edge of the sidewall plane 132 of the sidewall portion 130. The second sloped surface 132A is formed by cutting a part of the folding line F134 from an end of the folding line F134. The second sloped surface 132A is folded down along a folding line F132A so that the second sloped surface 132A is extended in a nonparallel direction to the sidewall plane 132. Thus, the folded first sloped surface 164A causes friction with the folded second sloped surface 132A when the support tab 160B slides out from the space S2 for withdrawal of the support tab 160B from the space S2 (see FIGS. 2A through 2D). The friction between the folded first sloped surface 164A and the folded second sloped surface 132A may prevent entire of the support tab 160B from being withdrawn from the space S2. The sidewall plane 122 of the sidewall portion 120 may also include another second sloped surface having the same structure as that of the second sloped surface 132A. As a result, the box 100 may be converted into a bowl type container when the box 100 is in a spread form.

Figure 1D:
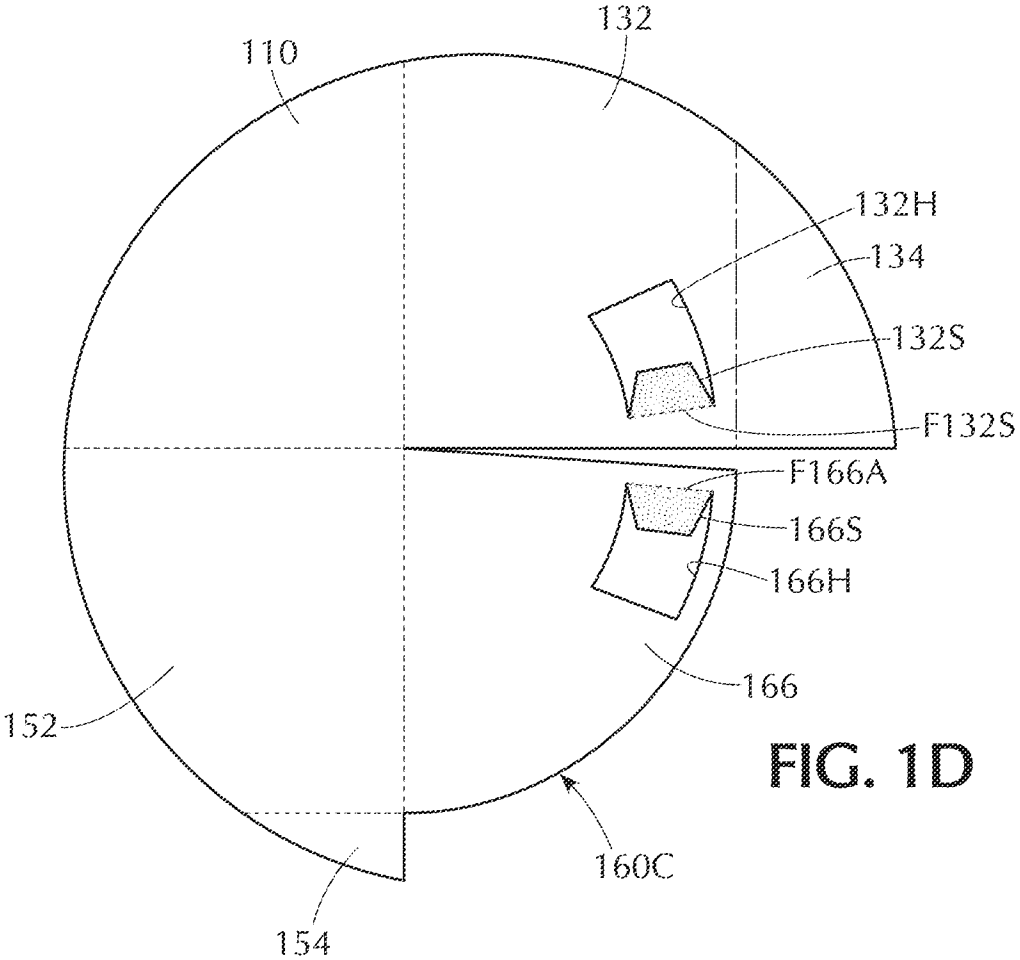

FIG. 1D is a partial top view showing an exemplary support tab 160C according to some embodiments. The box 100 in FIG. 1A may adopt one or more of the support tab 160C instead of the support tabs 160.

The support tab 160C has a main surface 166 connected to and extended from the first sidewall plane 152 of the sidewall portion 150 or the first sidewall plane 142 of the sidewall portion 140. A first hole 166H is formed through the main surface 166. And, a first sloped surface 166S is connected to the main surface 166 and extended from the main surface 166 into the first hole 166H. In detail, the first sloped surface 166S is folded up along a folding line F166S so as to be extended in a nonparallel direction to the main surface 166.

The sidewall plane 132 of the sidewall portion 130 has a second hole 132H formed through the sidewall plane 132, and a second sloped surface 132S connected to the sidewall plane 132. The second sloped surface 132S is extended from the sidewall plane 132 into the second hole 132H. The second sloped surface 132S is folded down along a folding line F132S so as to be extended in a nonparallel direction to the sidewall plane 132. The first sloped surface 166S causes friction with the second sloped surface 132S by cooperating with each other when the support tab 160C slides out from the space S2 for withdrawal of the support tab 160C from the space S2 (see FIGS. 2A through 2D). The friction between the first sloped surface 166S and the second sloped surface 132S may prevent entire of the support tab 160B from being withdrawn from the space S2. The sidewall plane 122 of the sidewall portion 120 may also include another second hole and another second sloped surface having the same structures as those of the second hole 132H and the second sloped surface 132S. As a result, the box 100 may be converted into a bowl type container when the box 100 is in a spread form.

Figure 1E:
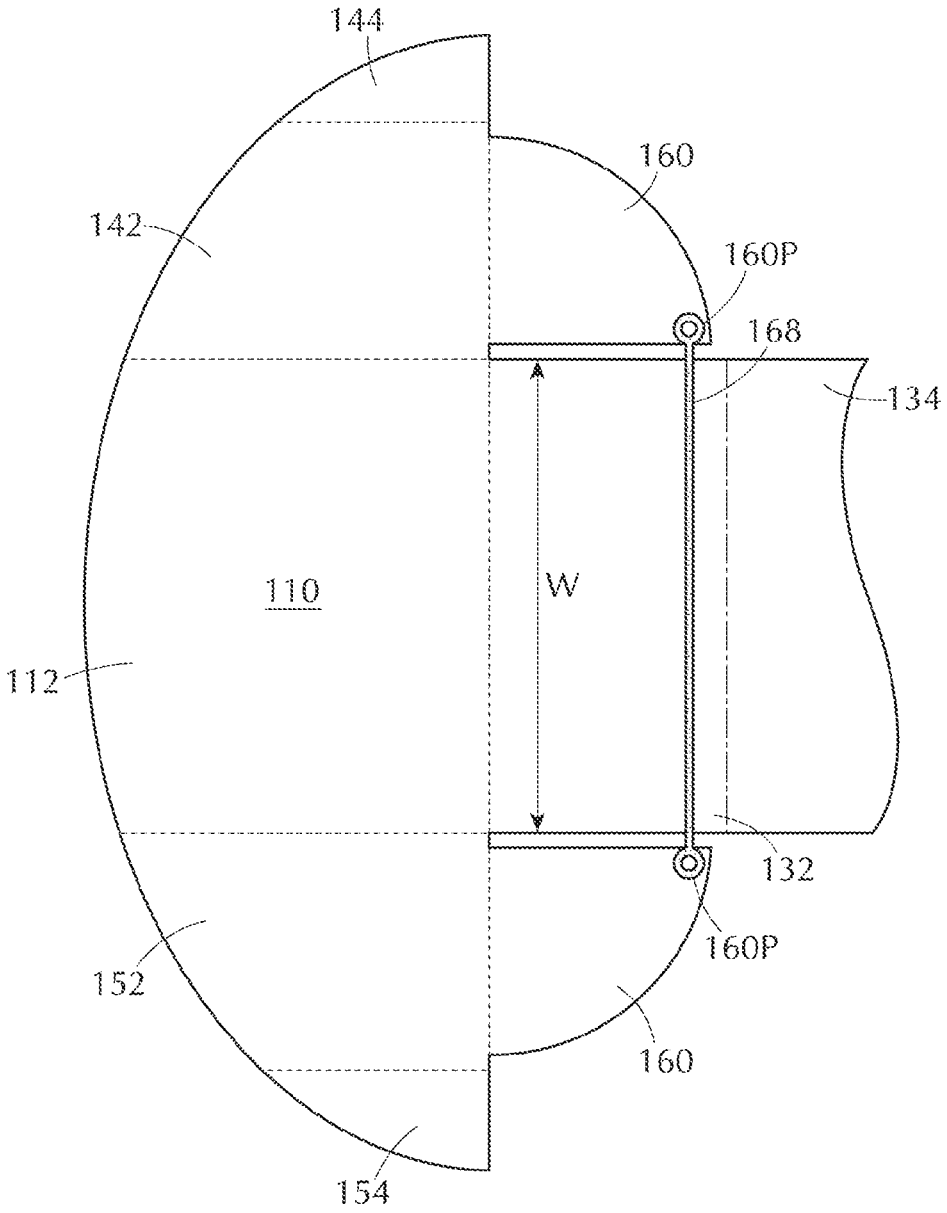

FIG. 1E is a partial top view showing an alternative example of the box 100 in FIG. 1A according to some embodiments. A connection 168 is positioned within the space S1 formed by the pair of the sidewall planes 122 and 124 for connecting neighboring two support tabs 160 through the space S1. Another connection 168 is also positioned within the space S2 formed by the pair of the sidewall planes 132 and 134 for connecting neighboring two support tabs 160 through the space S2, as shown in FIG. 1E. Both end of the connection 168 is fixed on respective fixing points 160P on the support tabs 160. The fixing points 160P are adjacent to each edge of the support tabs 160. The neighboring two support tabs 160 are inserted into the space S1 or S2 in order to secure the box 100 in an assembled form. And, the neighboring two support tabs 160 may be withdrawn from the space S2 in order to secure the box 100 in a spread form.

According to some embodiments, the connection 168 may be formed of a resilient material such as rubber or silicon. The connection 168 may have a form of a string. According to some embodiments, the connection 168 has a length greater than a width W of the side planes 132 and 134 when the connection 168 is in its stretched state as shown in FIG. 1E. And, the connection 168 has a length smaller than a width W of the side planes 132 and 134 when the connection 168 is in its contracted state in order to prevent entire of the neighboring two support tabs 160 from being withdrawn from the space S2 in order to secure the box 100 in a spread form. As a result, the box 100 may be converted into a bowl type container when the box 100 is in a spread form.

FIGS. 2A through 2H are perspective views schematically showing a sequential process for assembling the box 100.

Figure 2A:
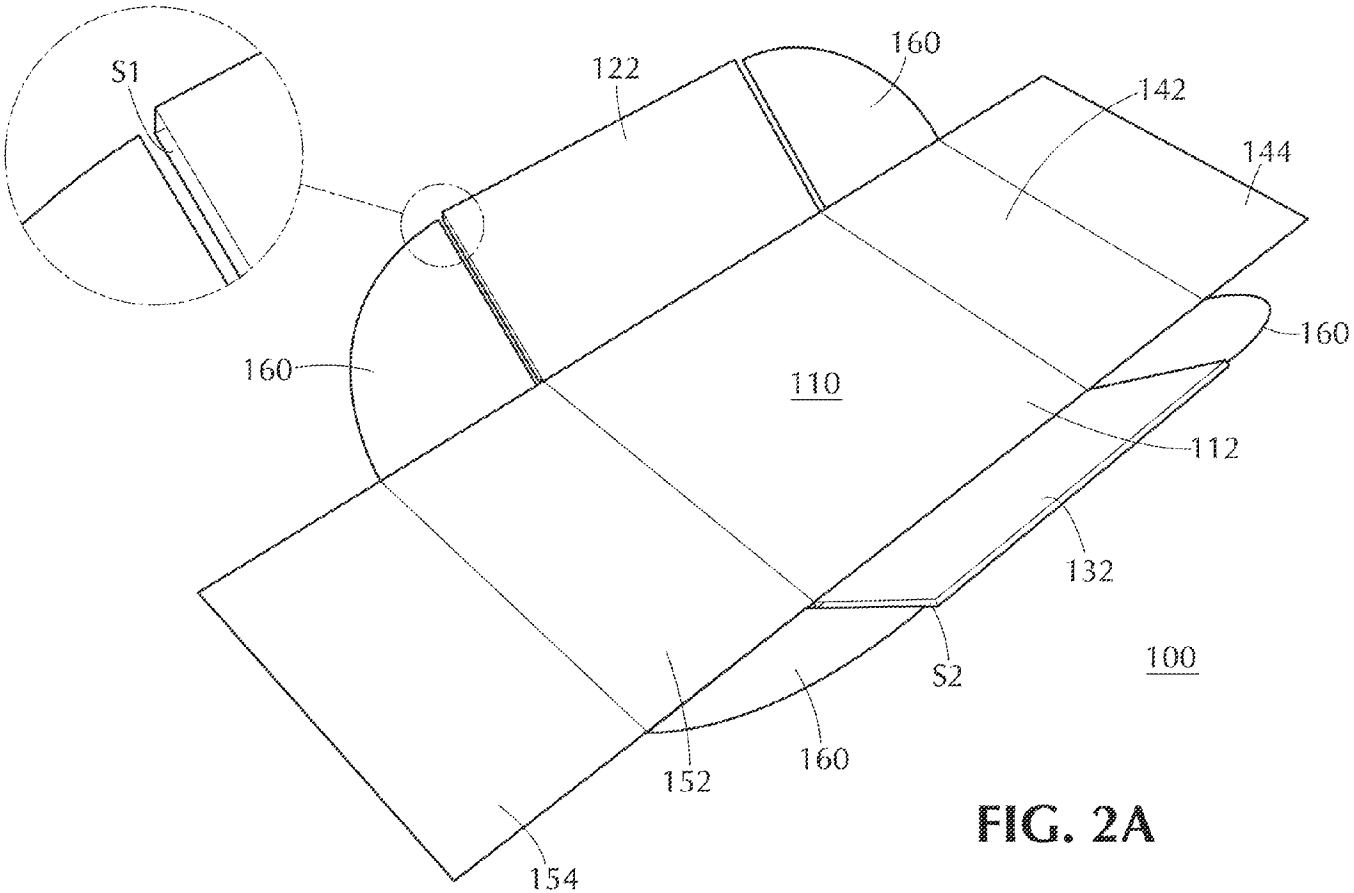
FIGS. 2A through 2H are perspective views schematically showing a sequential process for assembling the box according to some embodiments.
Figure 2B:
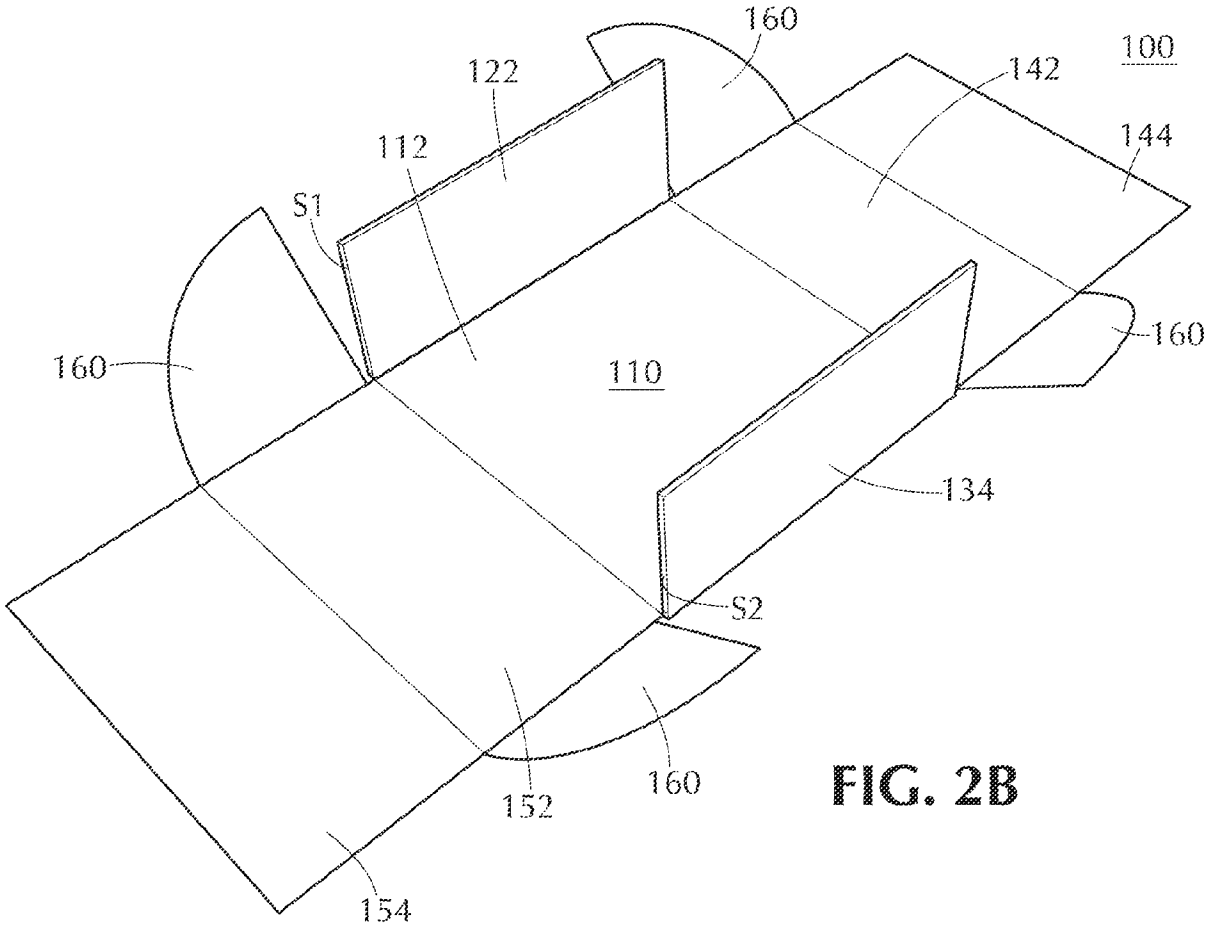
Figure 2C:
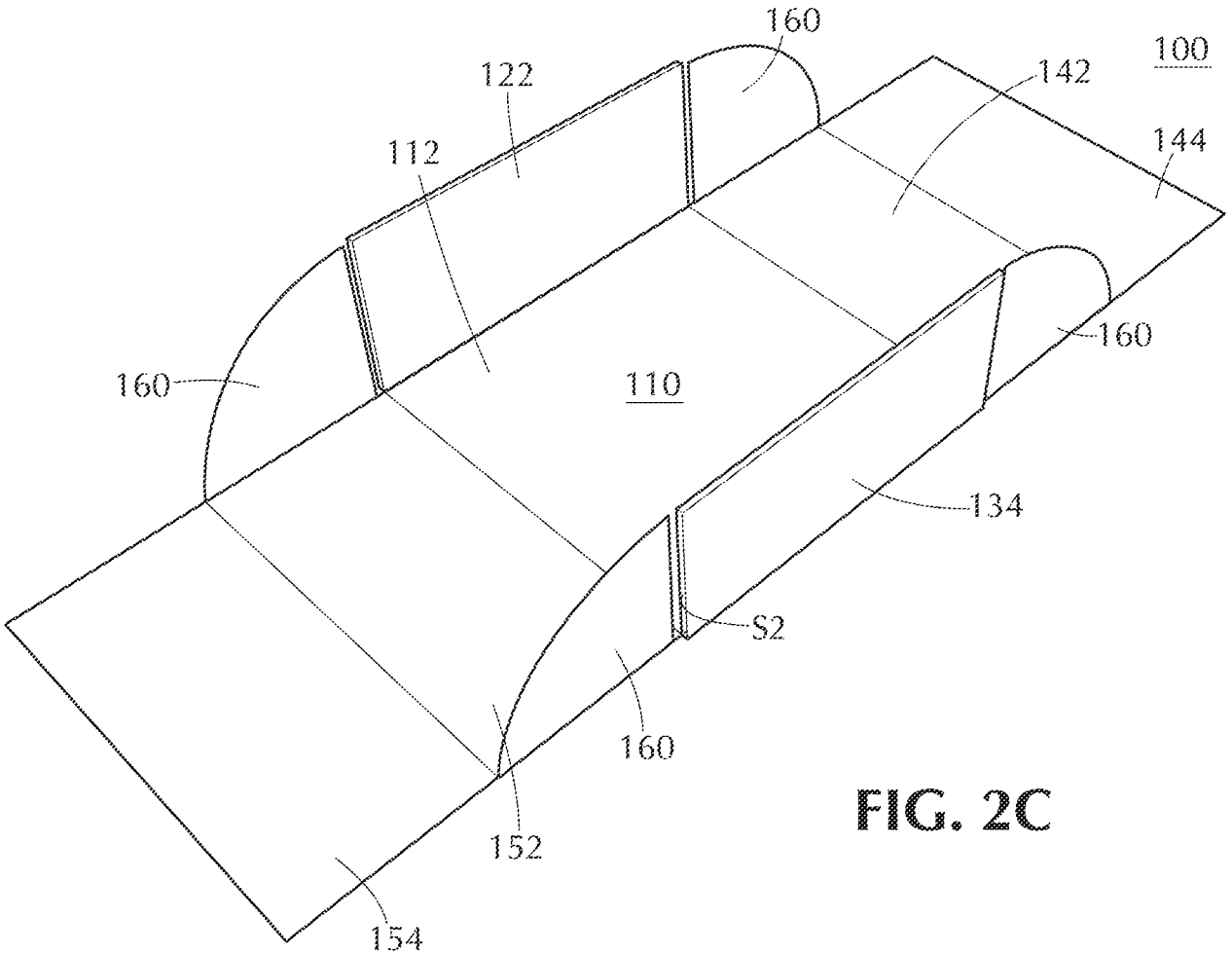

Specifically, FIG. 2A illustrates a state where the sidewall plane 124 is folded down to overlie the sidewall plane 122 and form the space S1, sidewall plane 134 is folded down to overlie the sidewall plane 132 and form the space S2, and the fixing planes 126 and 136 are folded down to overlie the bottom portion 110 and fixed to the backside of the bottom portion 110 using a fixing means such as adhesive paste material or an adhesive tape. FIG. 2B illustrates a state where the pair of sidewall planes 122 and 124 and the pair of sidewall planes 132 and 134 are folded up at a right angle with respect to the bottom portion 110. FIG. 2C illustrates a state where the support tabs 160 are folded up in parallel with the pair of sidewall planes 122 and 124 and the pair of sidewall planes 132 and 134, respectively.

Figure 2D:
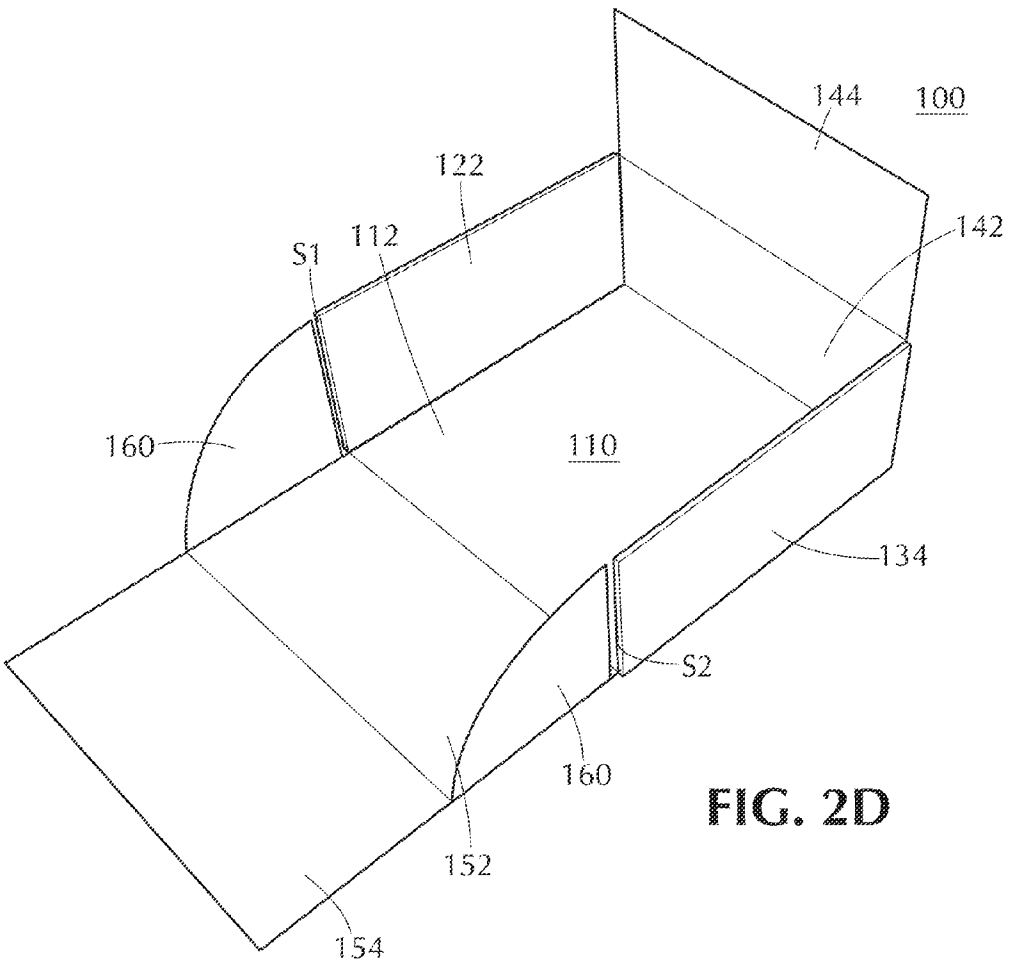
Figure 2E:
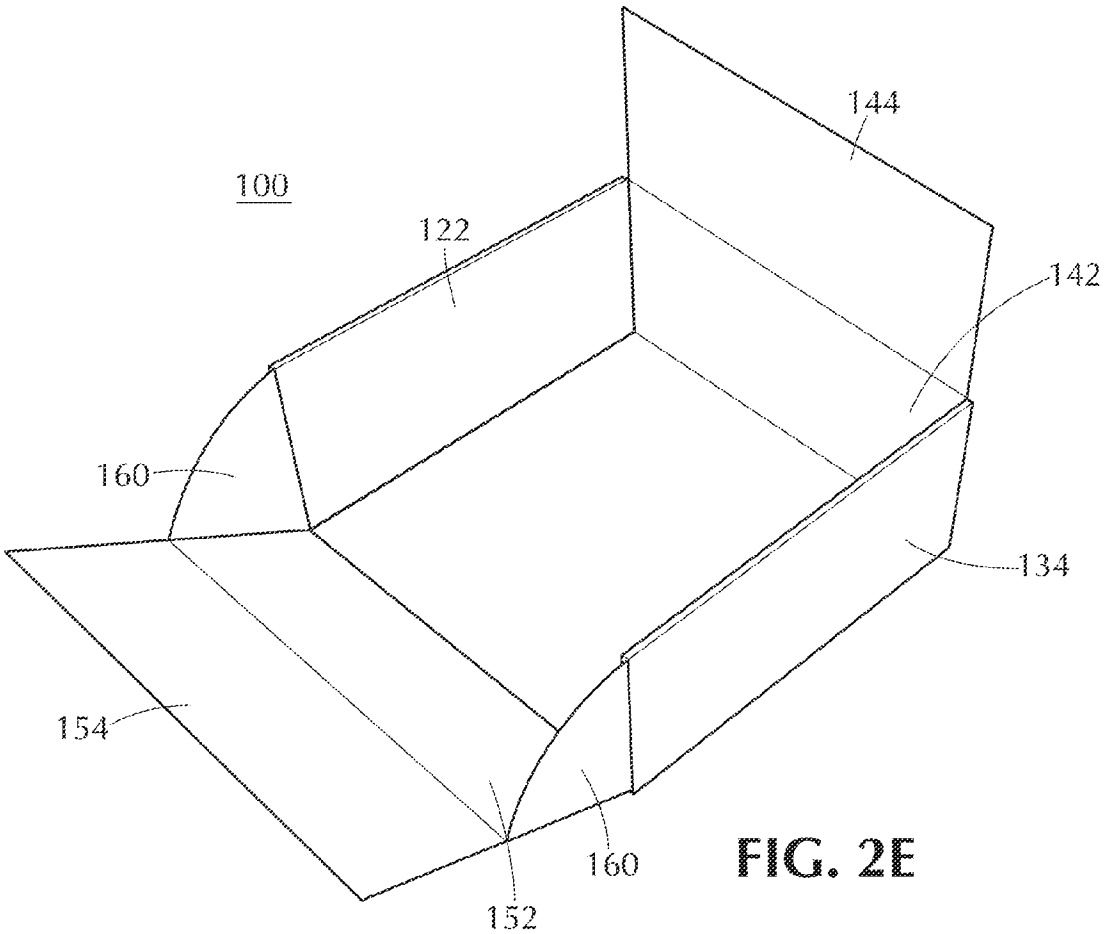

FIG. 2D illustrates a state where the first sidewall plane 142 is folded up at a right angle with respect to the bottom portion 110 so that each of the support tabs 160 protruded from the first sidewall plane 142 are completely inserted into the spaces S1 and S2. FIG. 2E illustrates a state where the first sidewall plane 152 is folded up to the extent that each of the support tabs 160 protruded from the first sidewall plane 152 are partially inserted into the spaces S1 and S2.

Figure 2F:
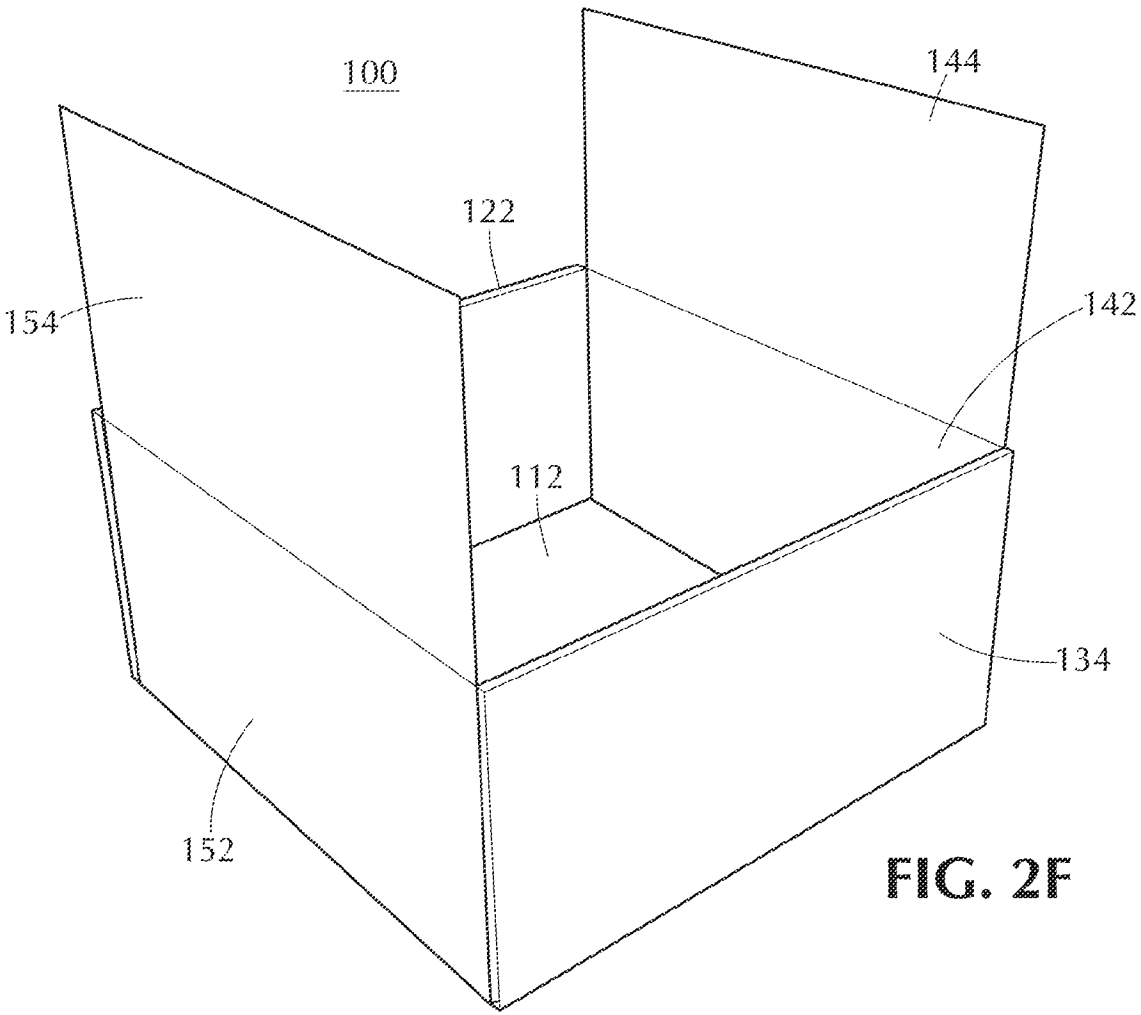
Figure 2G:
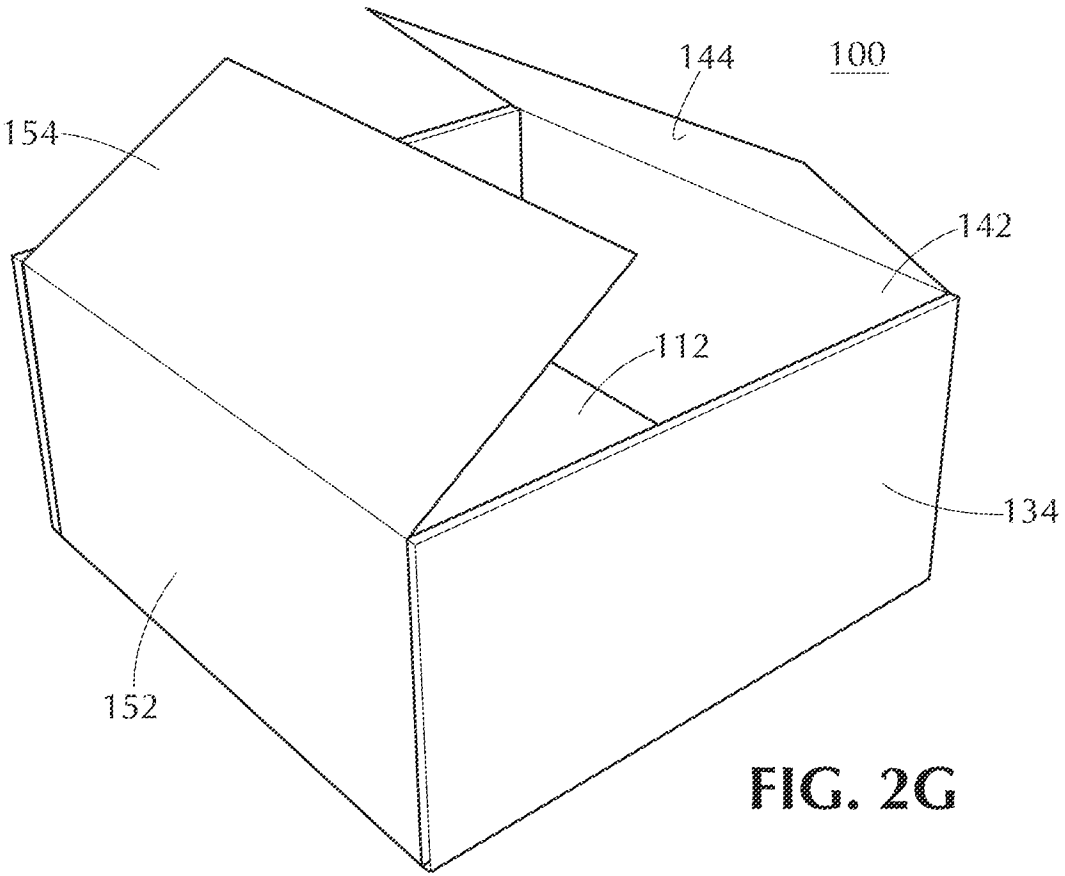
Figure 2H:
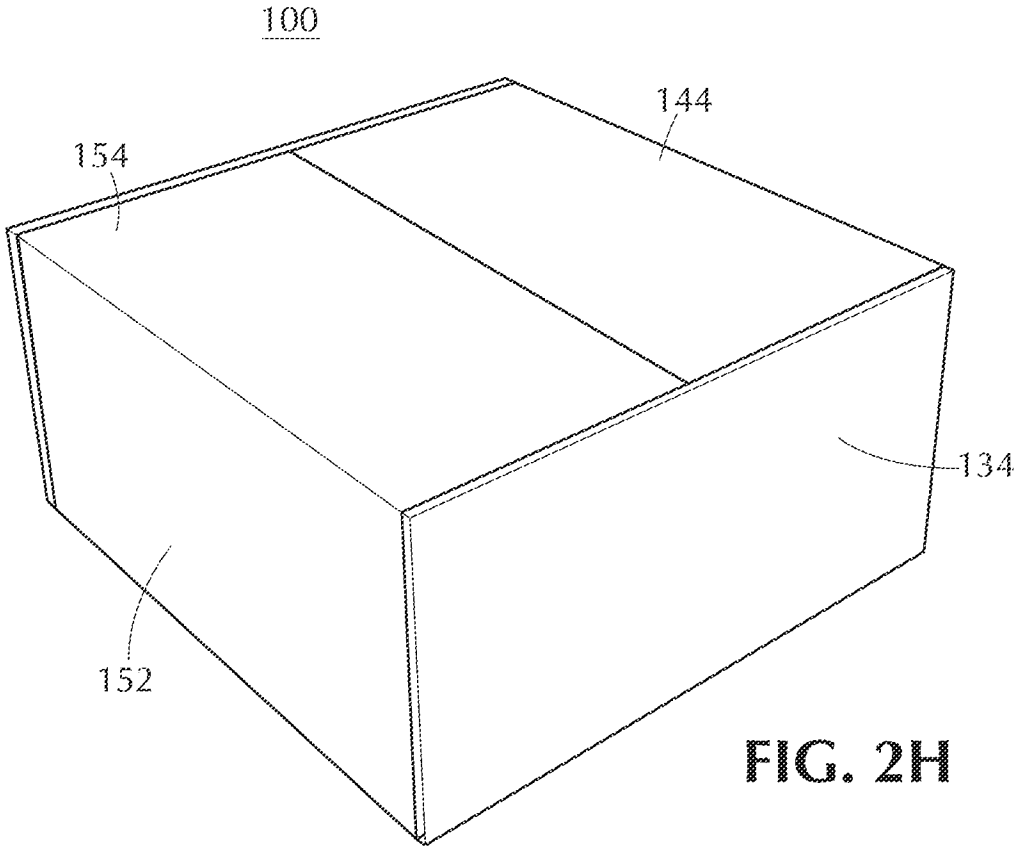
Figure 3:
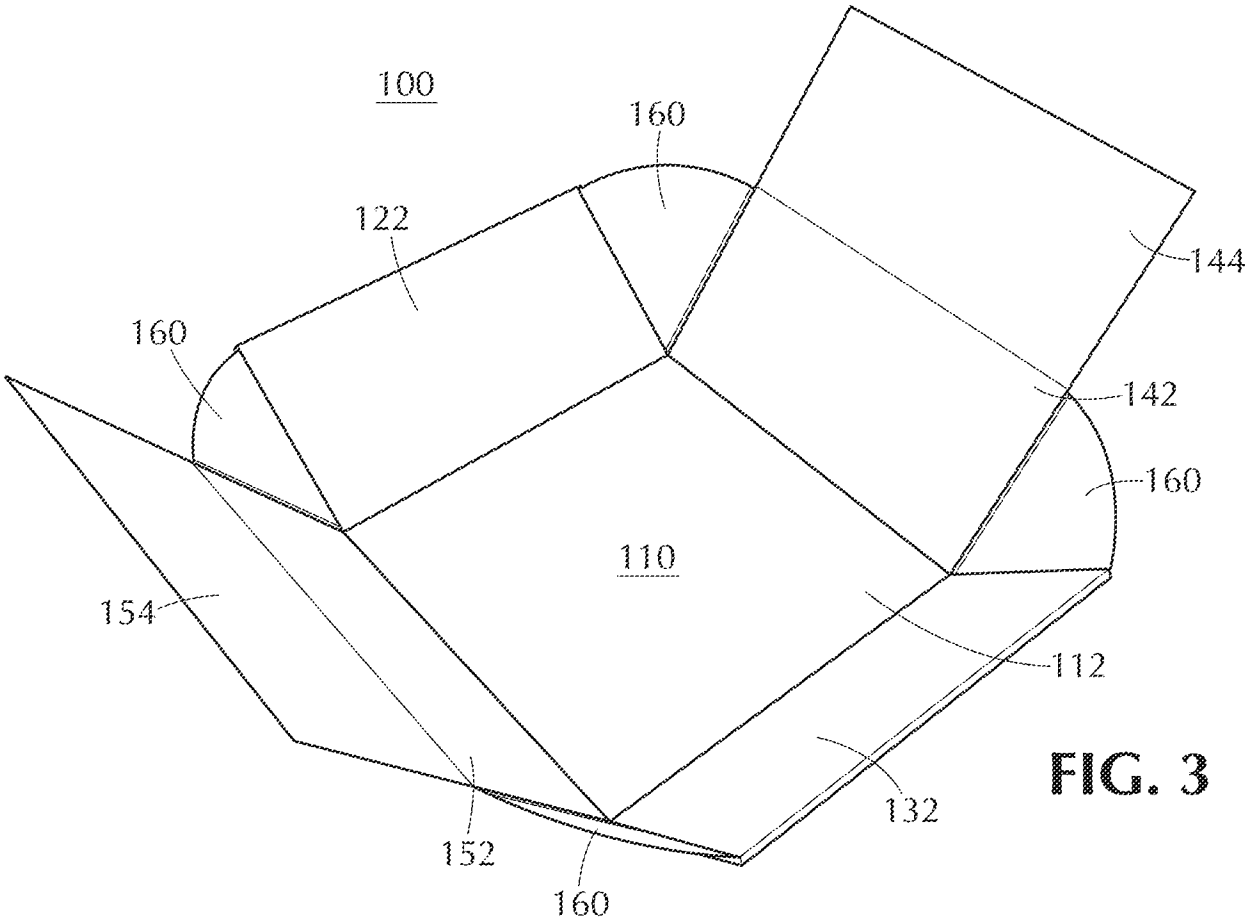
FIG. 3 is a perspective view schematically showing an exemplary box in a partially spread form according to some embodiments.

FIG. 2F illustrates a state where the first sidewall plane 152 is folded up at a right angle so that each of the support tabs 160 protruded from the first sidewall plane 152 are completely inserted into the spaces S1 and S2. FIG. 2G illustrates a state where the cover planes 144 and 154 are folded up to the extent that the box 100 is partially covered by the cover planes 144 and 154. FIG. 2H illustrates a state where the cover planes 144 and 154 are folded up to face with the bottom portion 110 so that the box 100 is completely covered by the cover planes 144 and 154. Referring to FIG. 3, the box 100 is opened by folding back the cover planes 144 and 154 and is secured in a partially spread form by partially withdrawing the support tabs 160 from the spaces S1 and S2 to convert the box 100 into a bowl type container.

Figure 4A:
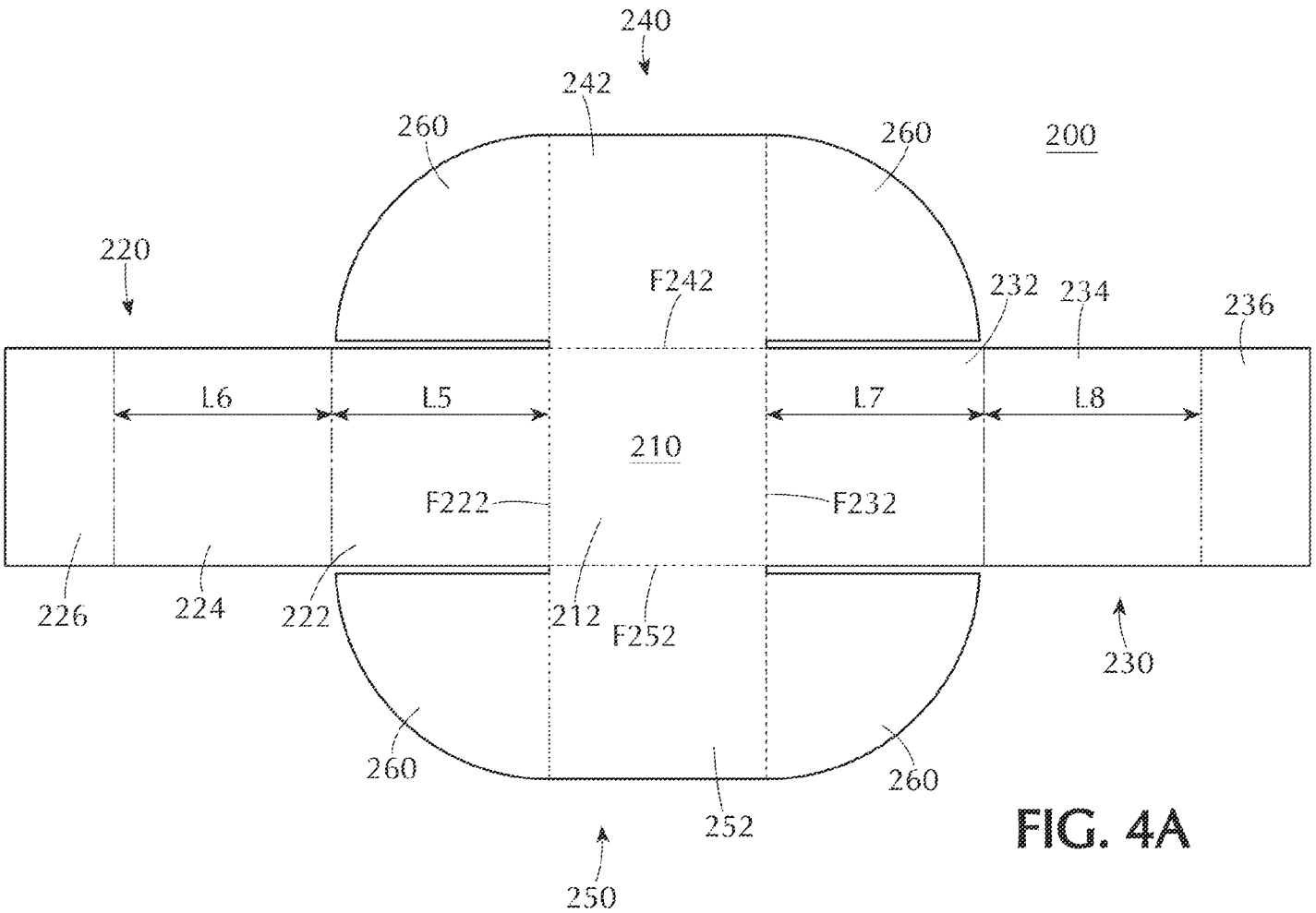
FIG. 4A is a top view of an exemplary box expanded out according to some embodiments.

Referring to FIG. 4A, a box 200 is expanded in a blank form useful for forming a spreadable box according to some embodiments. The box 200 has a square bottom portion 210, a plurality of sidewall portions 220, 230, 240 and 250, and a plurality of support tabs 260. Four edges of the square bottom portion 210 have equal length along the folding lines F222, F232, F242 and F252. Details of the square bottom portion 210, the plurality of sidewall portions 220, 230, 240 and 250, and the plurality of support tabs 260 are generally same as described about the bottom portion 110, the plurality of sidewall portions 120, 130, 140 and 150, and the plurality of support tabs 160 referring to FIG. 1A, excepting the followings.

The box 200 does not have any cover members such as the cover planes 144 and 154. The sidewall portion 220 includes a pair of sidewall planes 222 and 224 foldable to overlie each other with a space therebetween. And, the sidewall portion 230 includes a pair of sidewall planes 232 and 234 foldable to overlie each other with a space therebetween.

According to some embodiments, the pair of sidewall planes 222 and 224 may have lengths L5 and L6, and the pair of sidewall planes 232 and 234 may have lengths L7 and L8. The lengths L5, L6, L7 and L8 may be greater than the first length L1 or the third length L3. Therefore, an article having a greater height may be put in the box 200.

According to some embodiments, the sidewall portion 220 has a fixing plane 226 connected to an edge of the second sidewall plane 224. The fixing plane 226 is foldable to overlie the bottom portion 210. And, the sidewall portion 230 has a fixing plane 236 connected to an edge of the second sidewall plane 234. The fixing plane 236 is foldable to overlie the bottom portion 210. Backsides of the fixing planes 226 and 236 may be fixed or adhered to a backside of the bottom portion 210, respectively, using a fixing means such as adhesive paste material or an adhesive tape.

Each of the plurality of support tabs 260 is protruded from both sides of the plurality of sidewall portions 240 and 250. According to some embodiments, the bottom portion 210 includes a first bottom plane 212 integrally formed with the plurality of sidewall portions 220, 230, 240 and 250. The sidewall portions 240 and 250 include first sidewall planes 242 and 252, respectively.

Figure 4C:
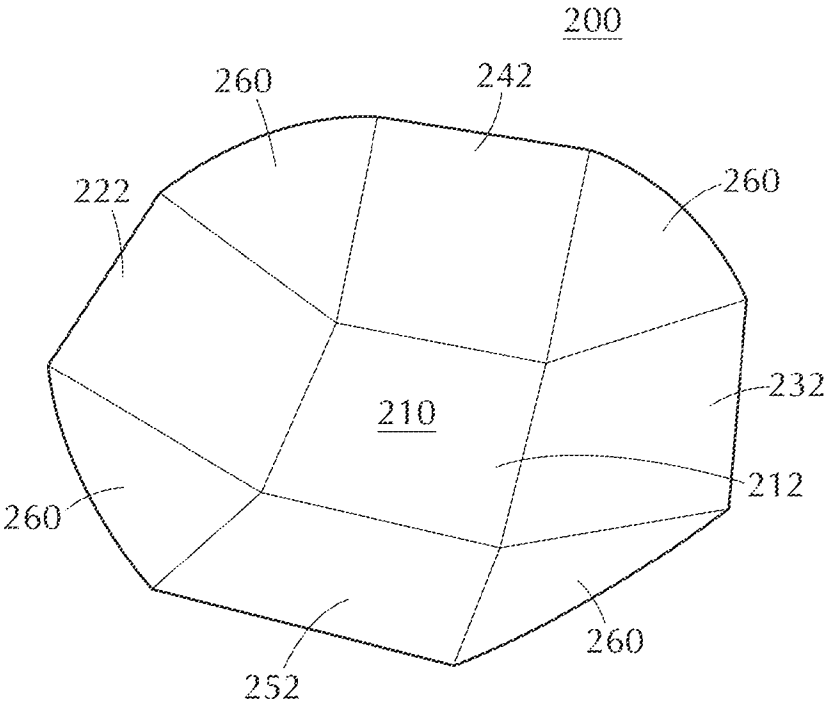
FIG. 4C is a perspective view of an exemplary box in a partially spread form according to some embodiments.
Figure 4B:
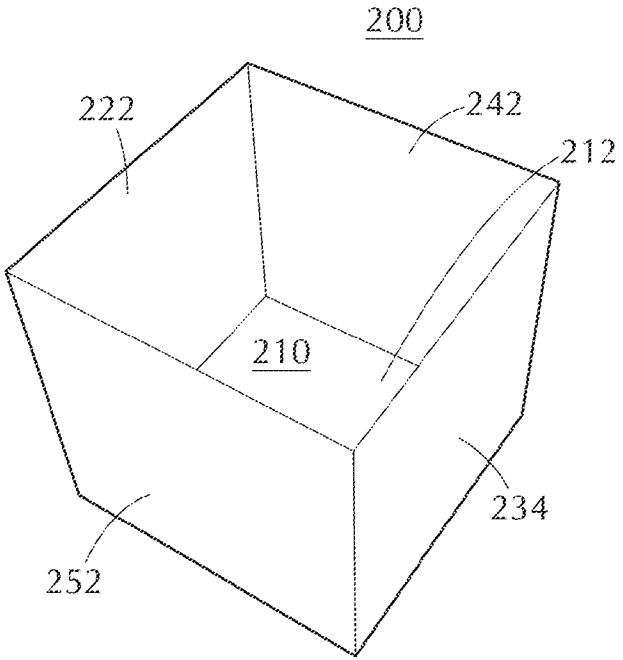
FIG. 4B is a perspective view of an exemplary box in an assembled form according to some embodiments.

FIG. 4B illustrates a box 200 in its assembled form. A separate cover member (not shown) may be adopted to cover the box 200 as required. Referring to FIG. 4C, the box 200 is secured in a partially spread state by partially withdrawing the support tabs 260 from the space between the pair of sidewall planes 222 and 224 and the space between the pair of sidewall planes 232 and 234, to convert the box 200 into a bowl type container.

Figure 5:
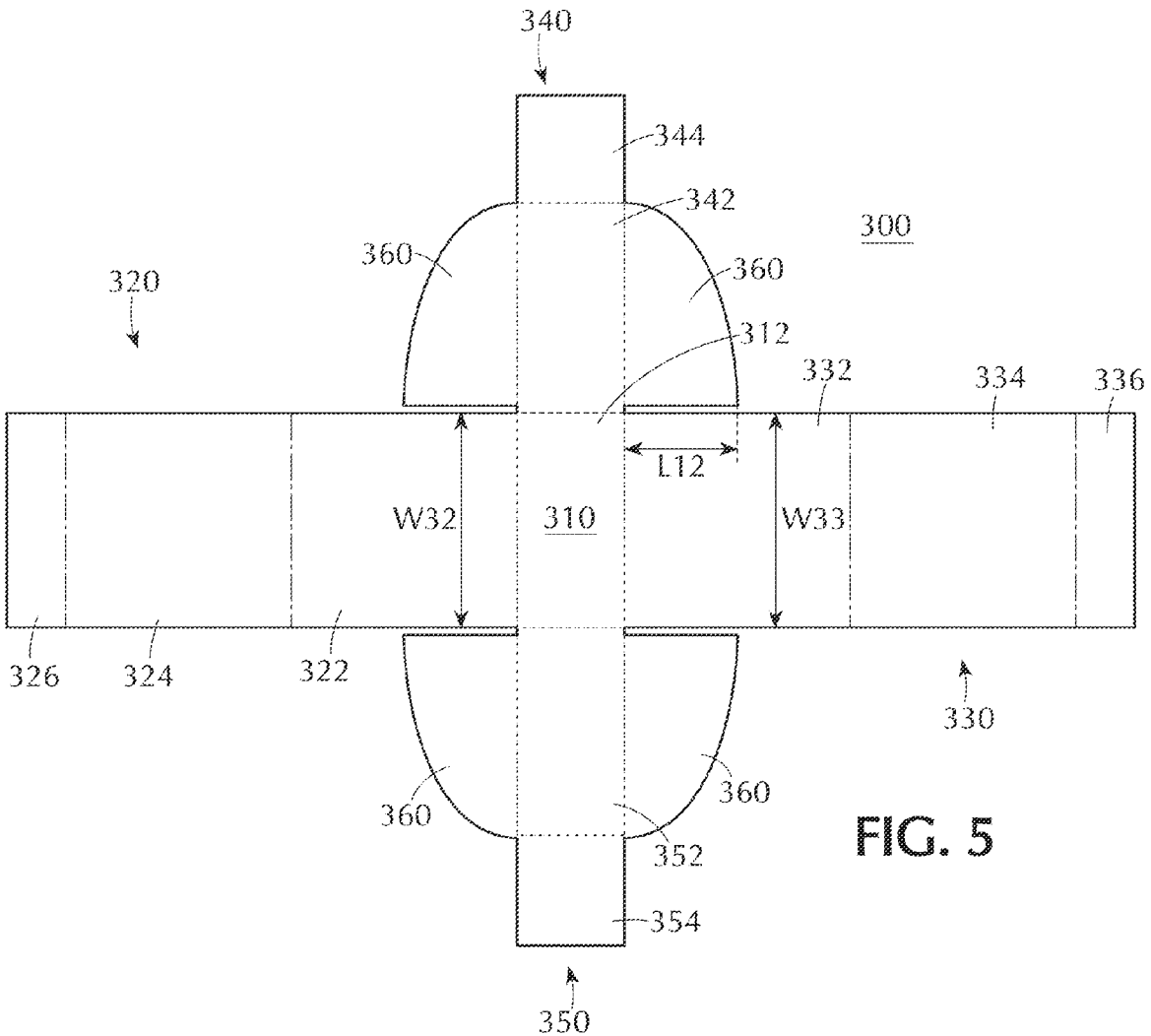
FIG. 5 is a top view of an exemplary box expanded out according to some embodiments.

Referring to FIG. 5, a box 300 is expanded in a blank form useful for forming a spreadable box according to some embodiments. The box 300 has a rectangular bottom portion 310, a plurality of sidewall portions 320, 330, 340 and 350, and a plurality of support tabs 360. Details of the rectangular bottom portion 310, the plurality of sidewall portions 320, 330, 340 and 350, and the plurality of support tabs 360 are generally same as described about the bottom portion 110, the plurality of sidewall portions 120, 130, 140 and 150, and the plurality of support tabs 160 referring to FIG. 1A, excepting the followings.

The sidewall portion 320 includes a pair of sidewall planes 322 and 324 foldable to overlie each other with a space therebetween, and a fixing plane 326. And, the sidewall portion 330 includes a pair of sidewall planes 332 and 334 foldable to overlie each other with a space therebetween, and a fixing plane 336.

The fixing plane 326 is foldable to overlie the bottom portion 310. And, the fixing plane 336 is foldable to overlie the bottom portion 310. Backsides of the fixing planes 326 and 336 may be fixed or adhered to a backside of the bottom portion 310, respectively, using a fixing means such as adhesive paste material or an adhesive tape.

Each of the plurality of support tabs 360 is protruded from both sides of the plurality of sidewall portions 340 and 350. According to some embodiments, the bottom portion 310 includes a first bottom plane 312 integrally formed with the plurality of sidewall portions 320, 330, 340 and 350. The sidewall portions 340 and 350 include first sidewall planes 342 and 352 and cover planes 344 and 354, respectively.

According to some embodiments, edges of the support tabs 360 adjacent to edges of the sidewall portions 320 and 330 have a length L12 smaller than a width W32 or W33 of the sidewall portions 320 and 330. More particularly, the length L12 may be equal to or smaller than a half of the widths W32 or W33. In this case, it is possible to prevent neighboring two support tabs 360 from being in contact with each other within the space formed by the pair of sidewall planes 322 and 324 or the space formed by the pair of sidewall planes 332 and 334, when the neighboring two support tabs 360 are inserted into the space in order to secure the box 300 in an assembled form.

Figure 6A:
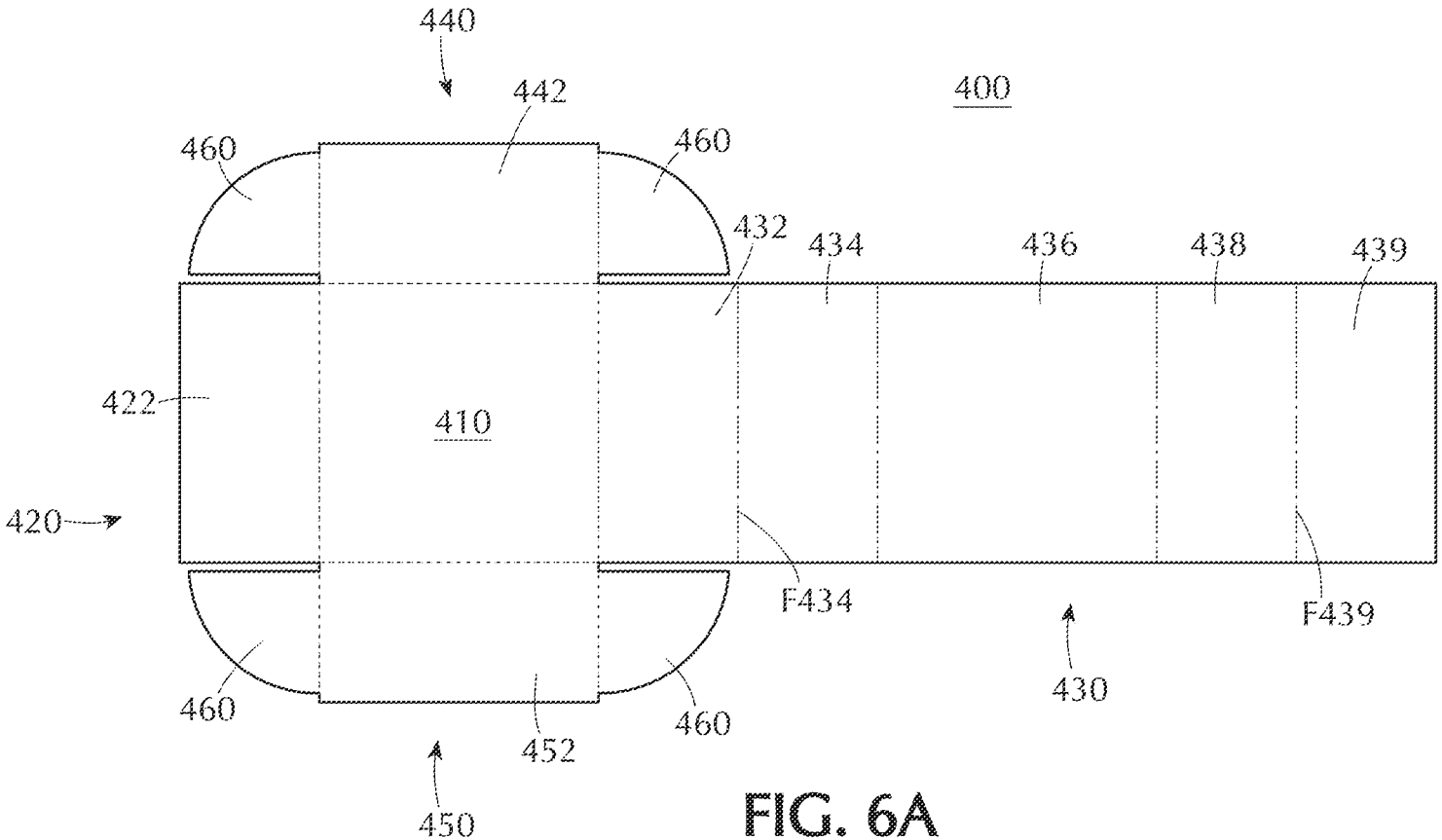
FIG. 6A is a top view of an exemplary box expanded out according to some embodiments.

Referring to FIG. 6A, a box 400 is expanded in a blank form useful for forming a spreadable box according to some embodiments. The box 400 has a rectangular bottom portion 410, a plurality of sidewall portions 420, 430, 440 and 450, and a plurality of support tabs 460. Details of the rectangular bottom portion 410, the plurality of sidewall portions 420, 430, 440 and 450, and the plurality of support tabs 460 are generally same as described about the bottom portion 110, the plurality of sidewall portions 120, 130, 140 and 150, and the plurality of support tabs 160 referring to FIG. 1A, excepting the followings.

In FIG. 6A, the box 400 has an asymmetrical structure. Specifically, length of the sidewall portion 420 is different from that of the sidewall portion 430. The sidewall portion 420 includes a first sidewall plane 422.

Figure 6B:
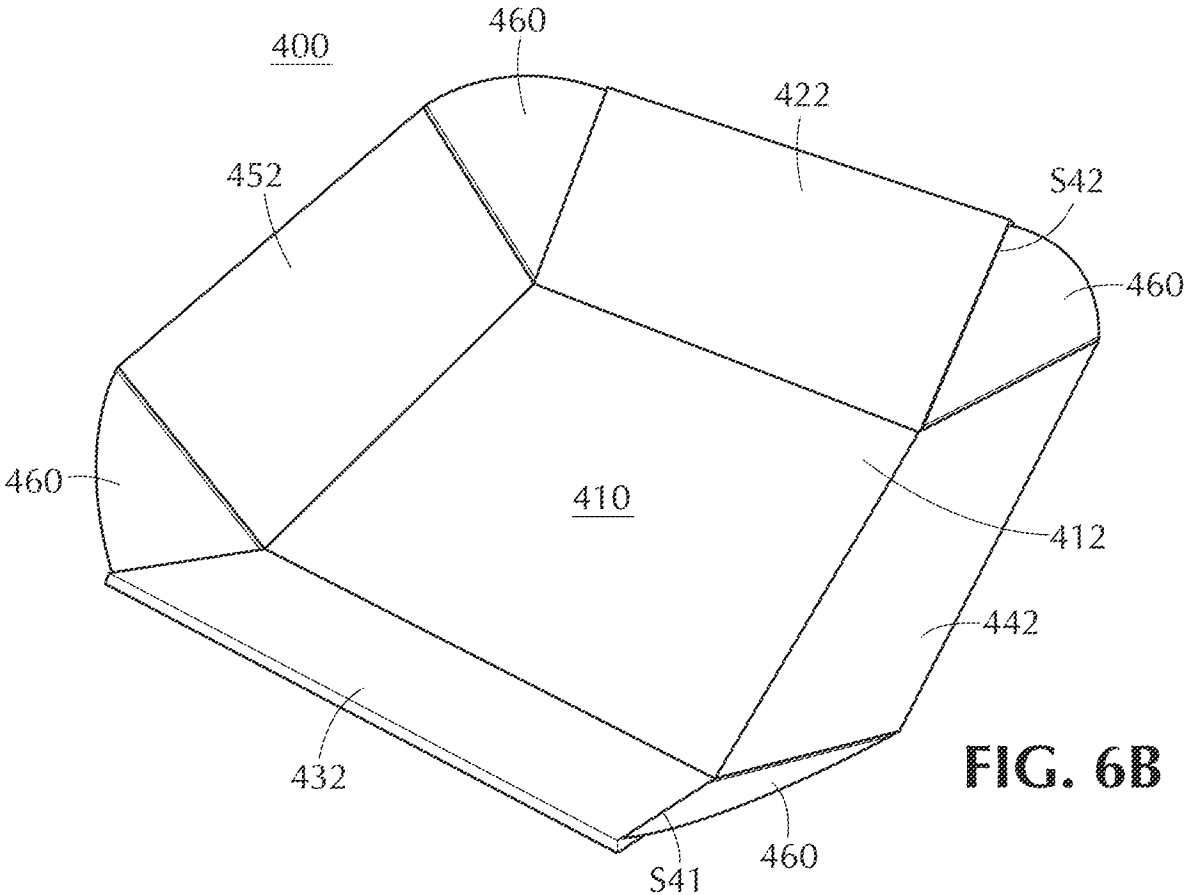
FIG. 6B is a perspective view of an exemplary box in a partially spread form according to some embodiments.

According to some embodiments, the sidewall portion 430 includes a pair of second sidewall planes 432 and 434 foldable along a folding line F434 between the pair of second sidewall planes 432 and 434 to overlie each other with a first space S41 therebetween (see FIG. 6B). The sidewall portion 430 further includes an additional bottom plane 436 connected to an edge of the second sidewall plane 434. The additional bottom plane 436 has substantially same shape and dimension as the bottom portion 410. The additional bottom plane 436 is foldable to overlie the bottom portion 410 so that a backside of the additional bottom plane 436 faces with a backside of the bottom portion 410. A backside of the additional bottom plane 436 is fixed or adhered to a backside of the bottom portion 410 using a fixing means such as adhesive paste material or an adhesive tape. The sidewall portion 430 still further includes a third sidewall plane 438 connected to an edge of the additional bottom plane 436. The third sidewall plane 438 is foldable to overlie the first sidewall plane 422 of the sidewall portion 420 with a second space S42 therebetween. A fixing plane 439 is connected to an edge of the third sidewall plane 438. The fixing plane 439 is folded down along a folding line F439 to overlie the first sidewall plane 422 so that a backside of the fixing plane 439 and a front surface of the first sidewall plane 422 are faced with each other. The backside of the fixing plane 439 may be fixed to the front surface of the first sidewall plane 422 using a fixing means such as adhesive paste material or an adhesive tape.

As an alternative example of the embodiments of FIG. 6A, the pair of second sidewall planes 432 and 434 is inwardly folded along a folding line F434 to overlie each other with a first space S41 therebetween. In this case, the additional bottom plane 436 is folded to overlie the bottom portion 410 so that a front surface of the additional bottom plane 436 faces with a front surface of the bottom portion 410. The front surface of the additional bottom plane 436 is fixed or adhered to the front surface of the bottom portion 410 using a fixing means such as adhesive paste material or an adhesive tape. The third sidewall plane 438 is foldable to overlie the first sidewall plane 422 of the sidewall portion 420 with a second space S42 therebetween. As an alternative example of the embodiment of FIG. 6A, the fixing plane 439 is inwardly folded up along a folding line F439 to overlie the first sidewall plane 422 so that a front surface of the fixing plane 439 and a backside of the first sidewall plane 422 are faced with each other. The front surface of the fixing plane 439 may be fixed to the backside of the first sidewall plane 422 using a fixing means such as adhesive paste material or an adhesive tape.

The plurality of support tabs 460 are configured to be inserted into the first space S41 and the second space S42, respectively, in order to secure the box 400 in an assembled form. Alternatively, the plurality of support tabs 460 are configured to be withdrawn from the first space S41 and the second space S42, respectively, in order to secure the box 400 in a spread form. Referring to FIG. 6B, the box 400 is secured in a partially spread form by partially withdrawing the support tabs 460 from the first space S41 and the second space S42 to convert the box 400 into a bowl type container.

Figure 7:
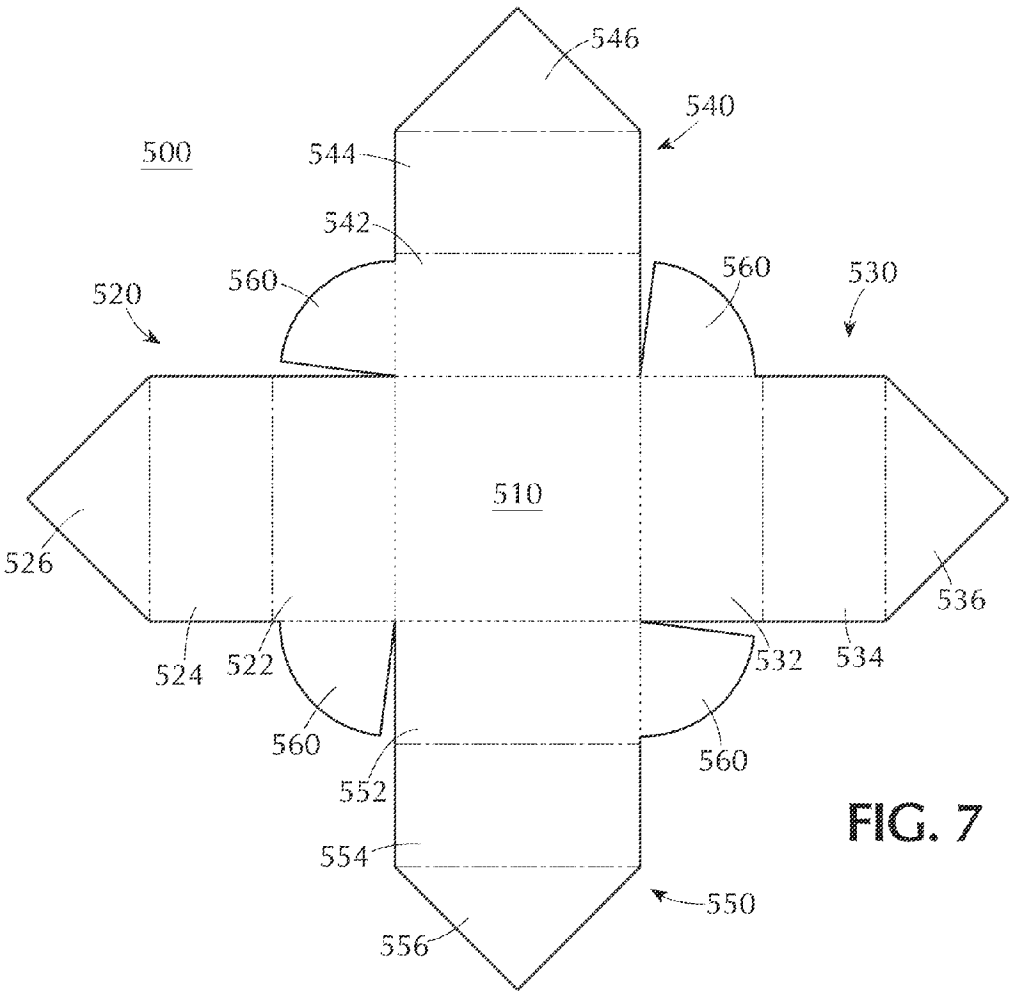
FIG. 7 is a top view of an exemplary box expanded out according to some embodiments.

Referring to FIG. 7, a box 500 is expanded in a blank form useful for forming a spreadable box according to some embodiments. The box 500 has a rectangular bottom portion 510, a plurality of sidewall portions 520, 530, 540 and 550, and a plurality of support tabs 560. Details of the rectangular bottom portion 510, the plurality of sidewall portions 520, 530, 540 and 550, and the plurality of support tabs 560 are generally same as described about the bottom portion 110, the plurality of sidewall portions 120, 130, 140 and 150, and the plurality of support tabs 160 referring to FIG. 1A, excepting the followings.

Each of the plurality of sidewall portions 520, 530, 540 and 550 are extended from the bottom portion 510 in radial directions. The plurality of sidewall portions 520, 530, 540 and 550 are substantially identical to one another. Specifically, the sidewall portion 520 includes a pair of sidewall planes 522 and 524 foldable to overlie each other with a space therebetween, and a fixing plane 526. The sidewall portion 530 includes a pair of sidewall planes 532 and 534 foldable to overlie each other with a space therebetween, and a fixing plane 536. The sidewall portion 540 includes a pair of sidewall planes 542 and 544 foldable to overlie each other with a space therebetween, and a fixing plane 546. And, the sidewall portion 550 includes a pair of sidewall planes 552 and 554 foldable to overlie each other with a space therebetween, and a fixing plane 556. Each of the fixing planes 526, 536, 646 and 556 is folded down to overlie the backside of the bottom portion 510 and fixed or adhered to the backside of the bottom portion 510 using a fixing means such as adhesive paste material or an adhesive tape. The fixing planes 526, 536, 546 and 556 meet at their edges without overlapping, when they are fixed or adhered to the backside of the bottom portion 510 by virtue of their triangular shape as shown in FIG. 7.

According to some embodiments, each of the plurality of support tabs 560 are protruded from one side of the plurality of sidewall portions 520, 530, 540 and 550. Each of the plurality of support tabs 560 are protruded in an anticlockwise direction as shown in FIG. 7 or in a clockwise direction. In order to secure the box 500 in an assembled form, each support tab 560 is inserted into adjacent one space among the spaces formed by the sidewall portions 520, 530, 540 and 550.

Figure 8A:
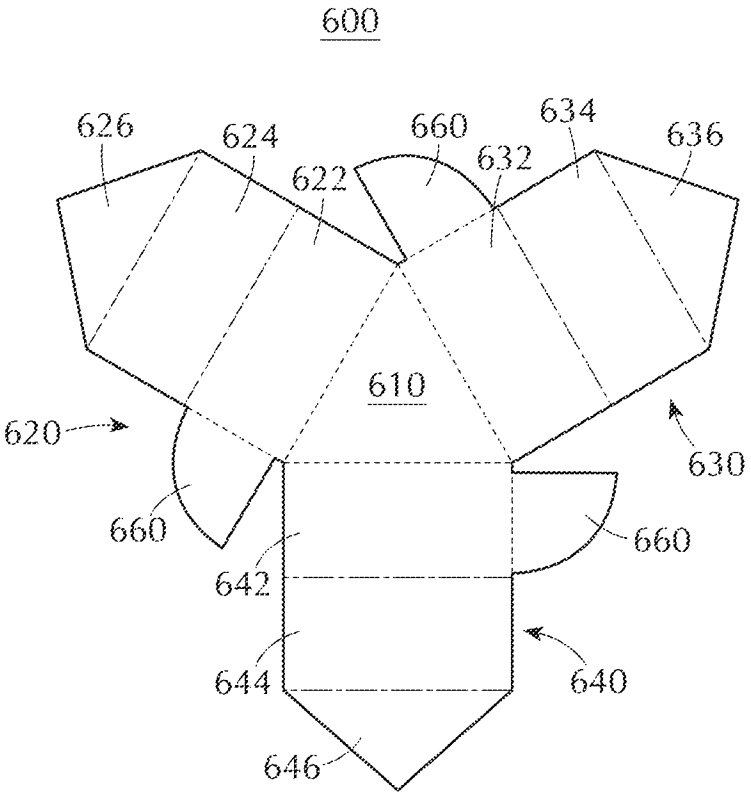
FIG. 8A is a top view of an exemplary box expanded out according to some embodiments.

Referring to FIG. 8A, a box 600 is expanded in a blank form useful for forming a spreadable box according to some embodiments. The box 600 has a triangular bottom portion 610, a plurality of sidewall portions 620, 630 and 640, and a plurality of support tabs 660. Details of the plurality of sidewall portions 620, 630 and 640, and the plurality of support tabs 660 are generally same as described about the plurality of sidewall portions 520, 530, 540 and 550, and the plurality of support tabs 560 referring to FIG. 7, excepting the followings.

Each of the plurality of sidewall portions 620, 630 and 640 is extended from the triangular bottom portion 610 in radial directions. The plurality of sidewall portions 620, 630 and 640 are substantially identical to one another. Specifically, the sidewall portion 620 includes a pair of sidewall planes 622 and 624 foldable to overlie each other with a space therebetween, and a fixing plane 626. The sidewall portion 630 includes a pair of sidewall planes 632 and 634 foldable to overlie each other with a space therebetween, and a fixing plane 636. And, the sidewall portion 640 includes a pair of sidewall planes 642 and 644 foldable to overlie each other with a space therebetween, and a fixing plane 646. Each of the fixing planes 626, 636 and 646 may be folded down to overlie the backside of the triangular bottom portion 610 and fixed or adhered to the backside of the triangular bottom portion 610 using a fixing means such as adhesive paste material or an adhesive tape. The fixing planes 626, 636 and 646 may meet at their edges without overlapping when they are fixed or adhered to the backside of the triangular bottom portion 610 by virtue of their triangular shape as shown in FIG. 8A.

According to some embodiments, each of the plurality of support tabs 660 are protruded from one side of the plurality of sidewall portions 620, 630 and 640. In FIG. 8A, each of the plurality of support tabs 660 are protruded in an anticlockwise direction as shown in FIG. 8A or in a clockwise direction. In order to secure the box 600 in an assembled form, each support tab 660 is inserted into adjacent one space among the spaces formed by the sidewall portions 620, 630 and 640.

Figure 8C:
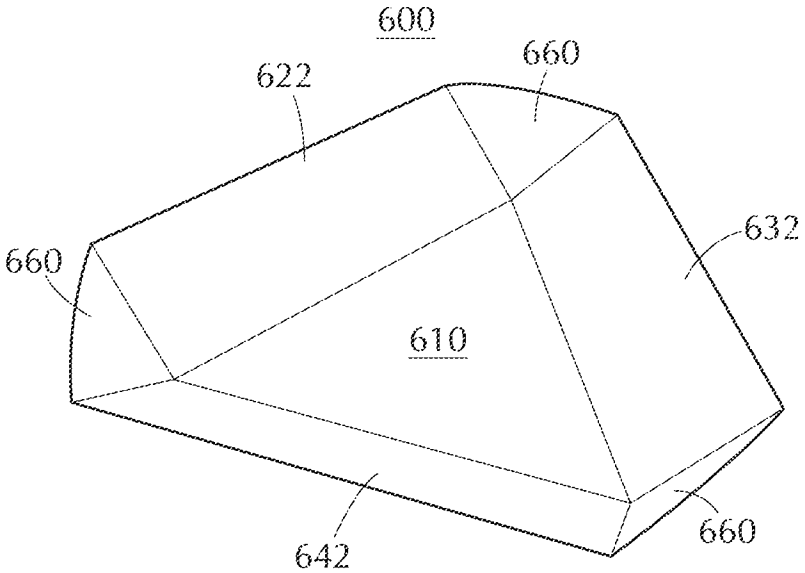
FIG. 8C is a perspective view of an exemplary box in a partially spread form according to some embodiments.
Figure 8B:
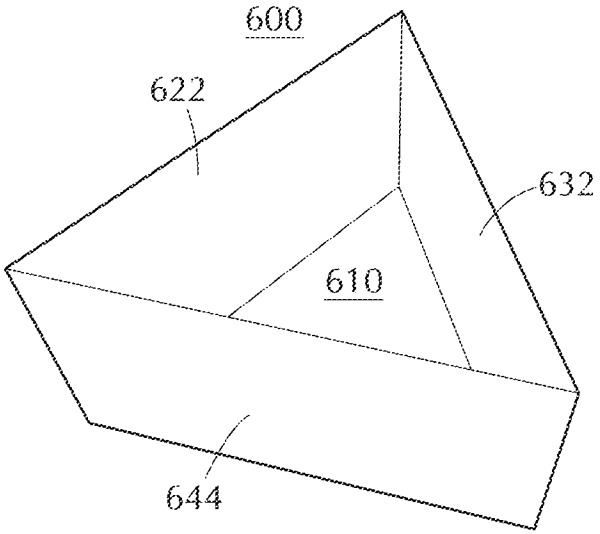
FIG. 8B is a perspective view of an exemplary box in an assembled form according to some embodiments.

FIG. 8B illustrates the box 600 in its assembled form. Referring to FIG. 8C, the box 600 is secured in a partially spread form by partially withdrawing the support tabs 660 from the spaces formed by the sidewall portions 620, 630 and 640 to convert the box 600 into a bowl type container.

Figure 9A:
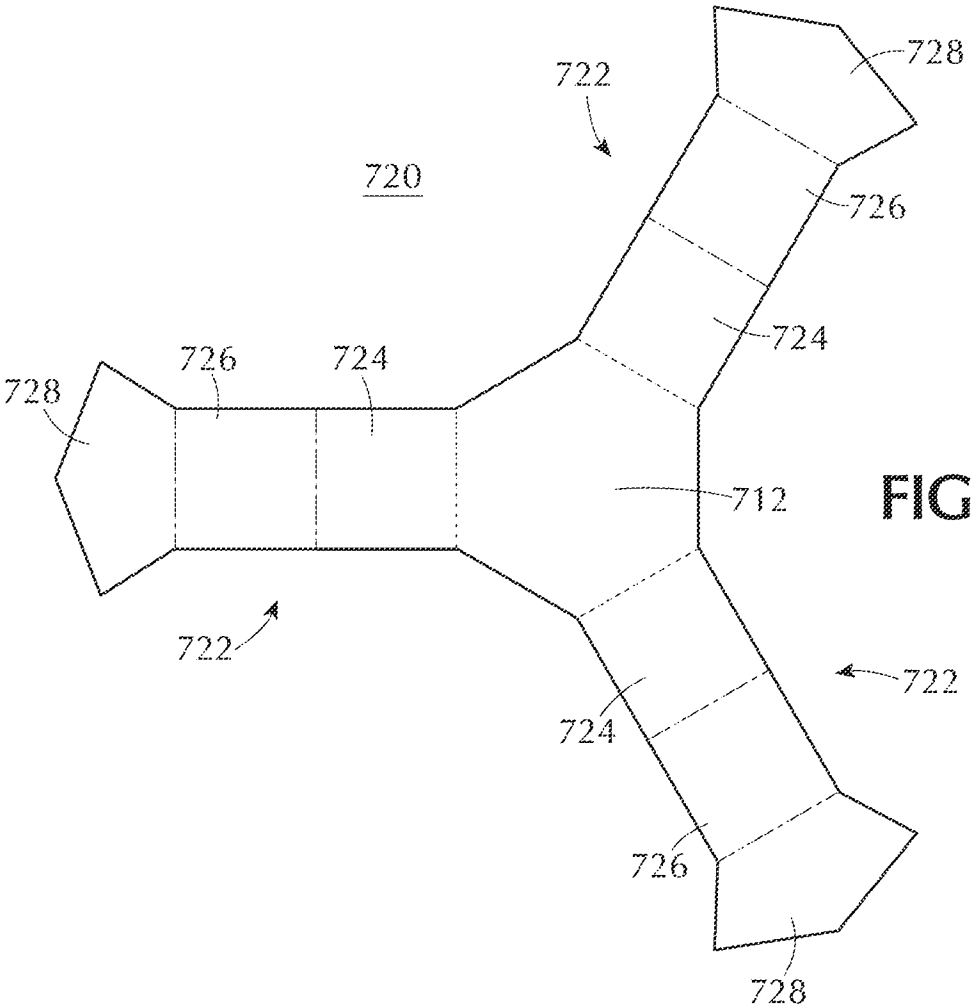
FIGS. 9A through 9E are top views of members for an exemplary box according to some embodiments.
Figure 9C:
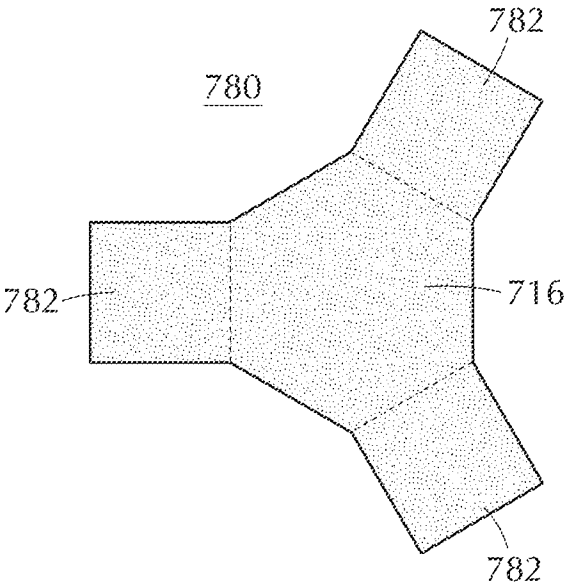
Figure 9B:
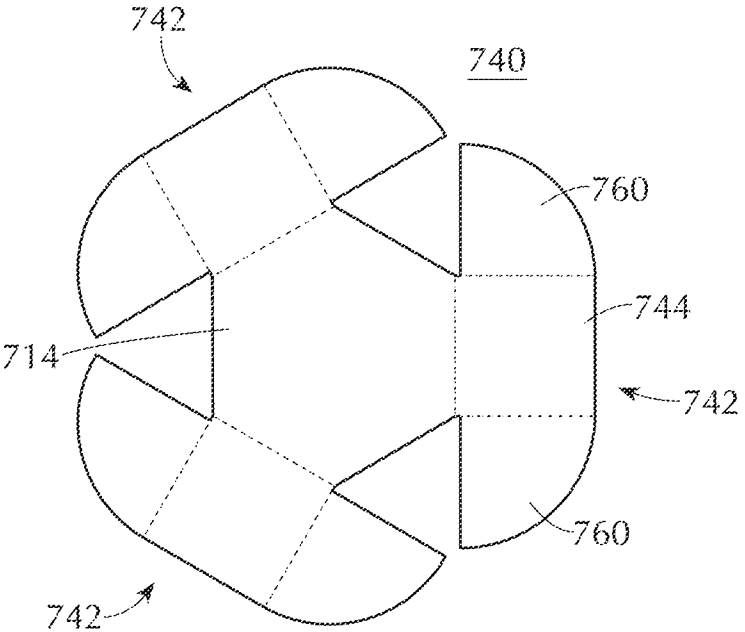
Figure 9D:
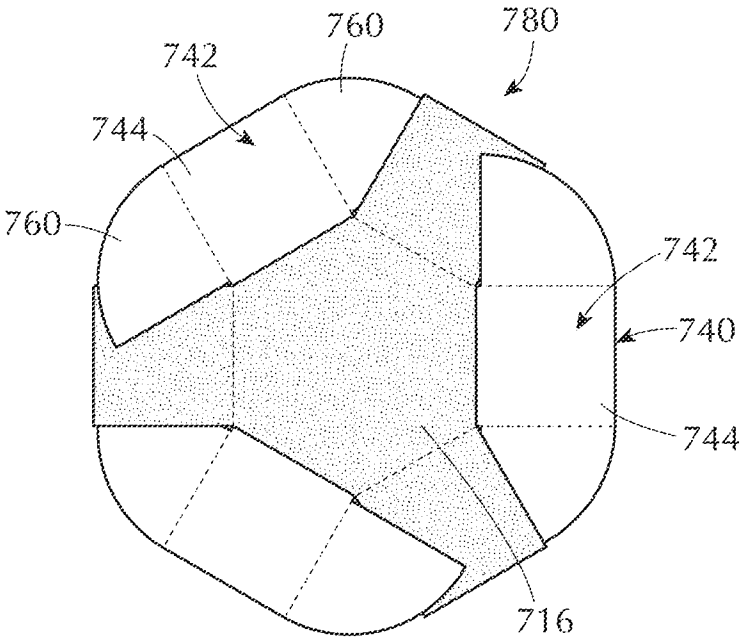
Figure 9E:
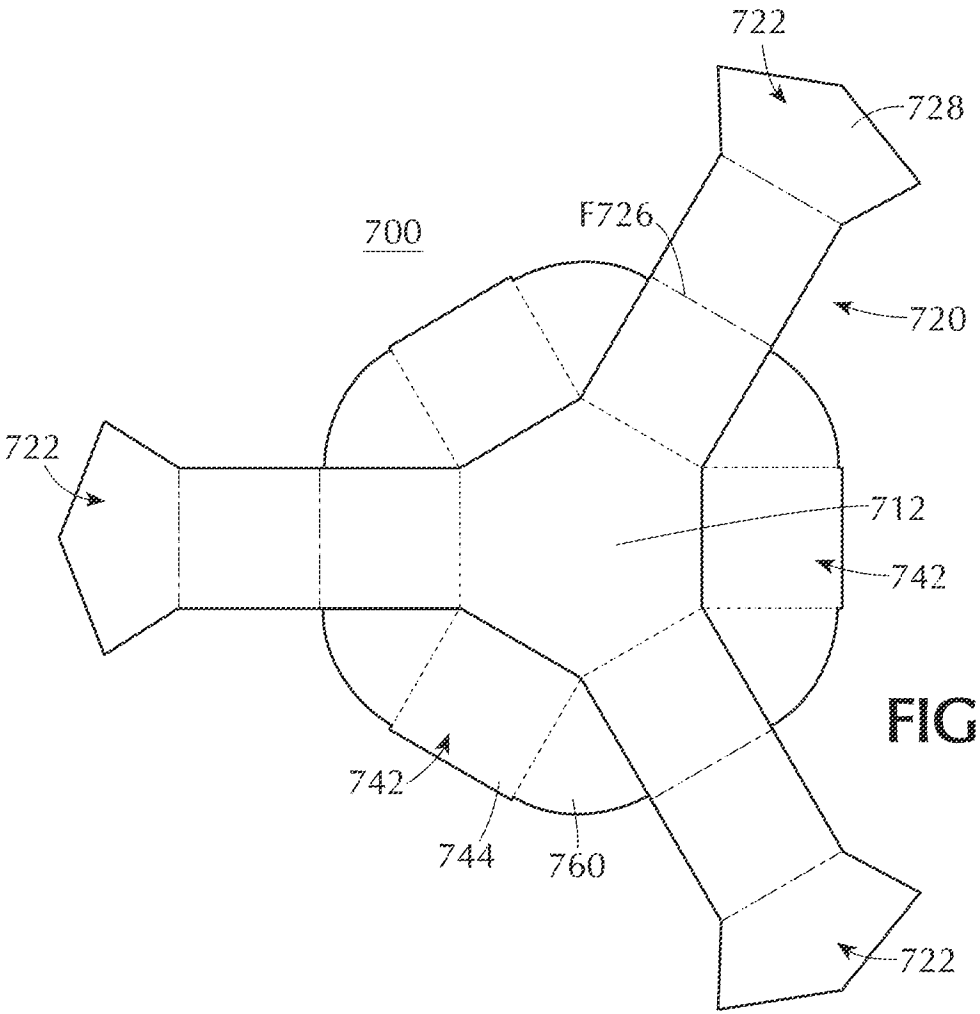

FIGS. 9A through 9D illustrate exemplary members for a box 700 shown in FIG. 9E. Specifically, FIG. 9A shows a first sidewall member 720 including a first bottom plane 712 and a plurality of first sidewall portions 722. The first bottom plane 712 has a hexagon surface. The plurality of first sidewall portions 722 is extended from edges of the first bottom plane 712. In FIG. 9A, the first sidewall member 720 includes three first sidewall portions 722 extending from every other edge among six edges of the first bottom plane 712 in a radial direction.

Each of the first sidewall portions 722 includes a pair of sidewall planes 724 and 726 foldable to overlie each other with a space therebetween. And, each of the first sidewall portions 722 includes a fixing plane 728 integrally connected to an edge of the sidewall plane 726. The fixing plane 728 is located at an end part of the first sidewall portions 722. The fixing plane 728 is foldable to overlie the first bottom plane 712 to be fixed under the backside of the first bottom plane 712.

FIG. 9B shows a second sidewall member 740 including a second bottom plane 714 and a plurality of second sidewall portions 742. The second bottom plane 714 has the same shape as the first bottom plane 712. Thus, in FIG. 9B, the second bottom plane 714 has a hexagon surface. The plurality of second sidewall portions 742 is extended from edges of the second bottom plane 714. In FIG. 9B, the second sidewall member 740 includes three second sidewall portions 742 extended from every other edge among six edges of the second bottom plane 714 in a radial direction.

Each of the second sidewall portions 742 includes a sidewall plane 744. A plurality of support tabs 760 are protruded from an edge of the sidewall planes 744. In FIG. 9B, the support tabs 760 are protruded from both sides of the sidewall plane 744.

Referring to FIG. 9C, the box 700 may further include an inner wall member 780 according to some embodiments. The inner wall member 780 has a third bottom plane 716 and a plurality of third sidewall portions 782 extended from the third bottom plane 716. The third bottom plane 716 has the same shape as the first bottom plane 712. In FIG. 9C, the third bottom plane 716 has a hexagon surface. The third bottom plane 716 is interposed between the first bottom plane 712 and the second bottom plane 714, when the first sidewall member 720, the second sidewall member 740 and the inner wall member 780 are assembled to form the box 700. The inner wall member 780 may be omitted in assembling the box 700.

Referring to FIG. 9D, the third bottom plane 716 of the inner wall member 780 overlies a front surface of the second bottom plane 714 of the second sidewall member 740 so that the third sidewall portions 782 are interposed between neighboring two support tabs 760.

Referring to FIG. 9E, the first bottom plane 712 of the first sidewall member 720 overlies a front surface of the third bottom plane 716 of the inner wall member 780 so that the third sidewall portions 782 of the inner wall member 780 are covered by the pair of sidewall planes 724 and 726 of the first sidewall member 720. Each of the plurality of first sidewall portions 722 of the first sidewall member 720 are alternatively arranged with each of the plurality of second sidewall portions 742 of the second sidewall member 740 around the first bottom plane 712.

When the pair of sidewall planes 724 and 726 of the first sidewall member 720 are folded down along a folding line F726 to form the space therebetween, the third sidewall portions 782 become located within the space formed by the pair of sidewall planes 724 and 726, and the third sidewall portions 782 separates the same space into two paths through each of which one of the support tabs 760 moves. Therefore, it is possible to prevent neighboring two support tabs 760 from contacting each other within the space by virtue of the third sidewall portions 782, when the neighboring two support tabs 760 are inserted into or withdrawn from the space in order to secure the box 700 in an assembled form or a spread form.

In case of omitting the inner wall member 780, the first bottom plane 712 of the first sidewall member 720 may overlie the front surface of the second bottom plane 714 of the second sidewall member 740.

Figure 9G:
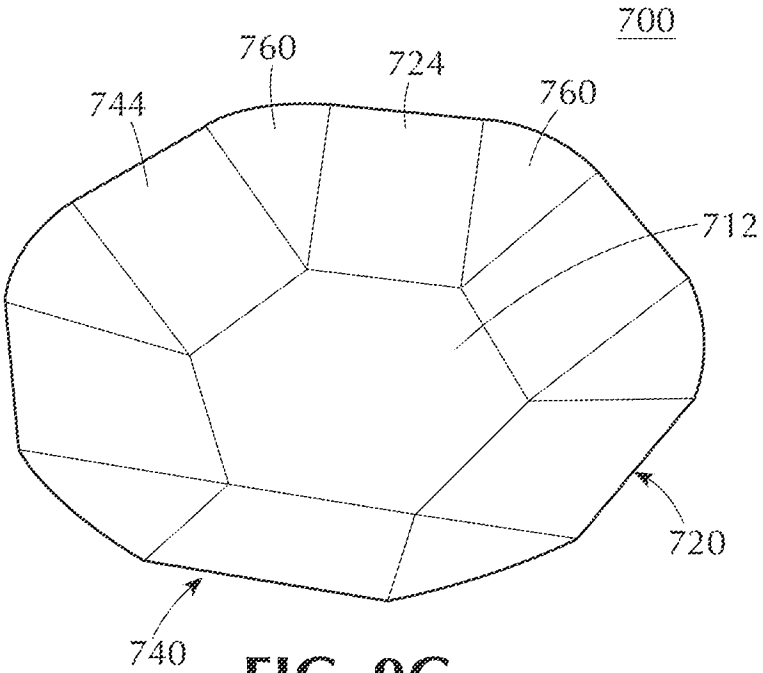
FIG. 9G is a perspective view of an exemplary box in a partially spread form according to some embodiments.
Figure 9F:
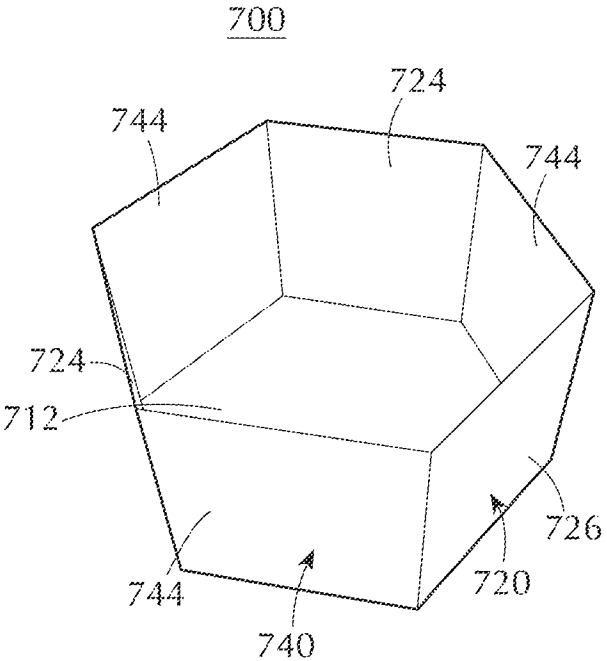
FIG. 9F is a perspective view of an exemplary box in an assembled form according to some embodiments.

FIG. 9F illustrates the box 700 in its assembled form. Referring to FIG. 9G, the box 700 is secured in a partially spread form by partially withdrawing the support tabs 760 from the spaces formed by the first sidewall member 720 to convert the box 700 into a bowl type container.

Figure 10A:
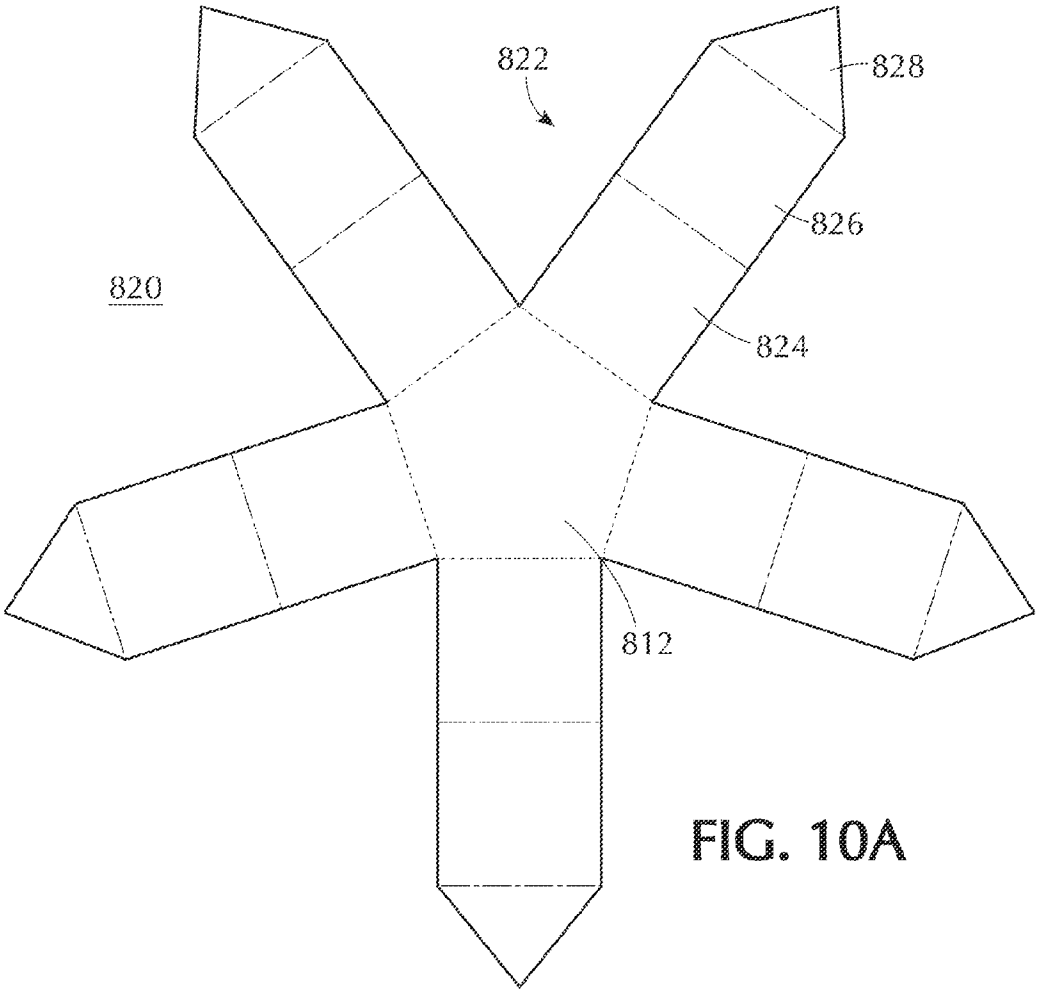
FIGS. 10A through 10C are top views of members for an exemplary box according to some embodiments.
Figure 10B:
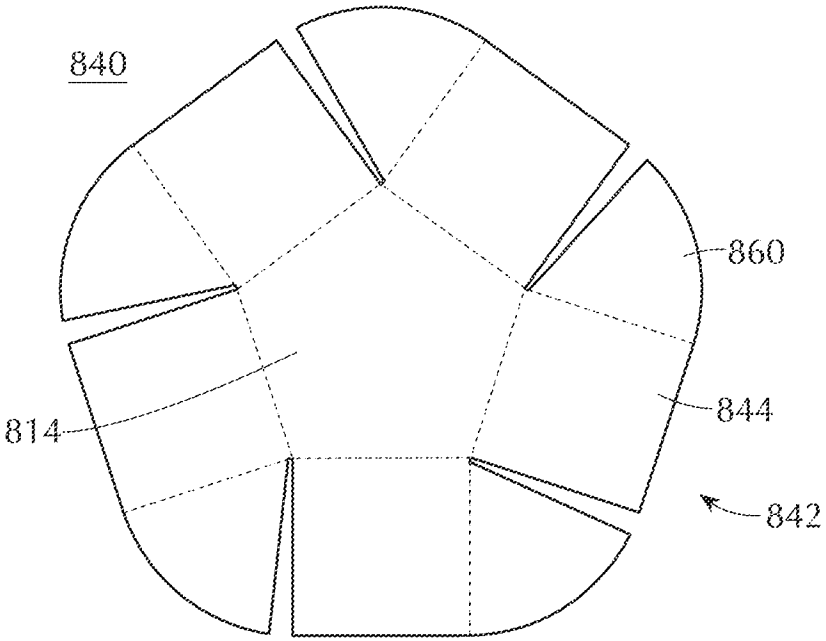
Figure 10C:
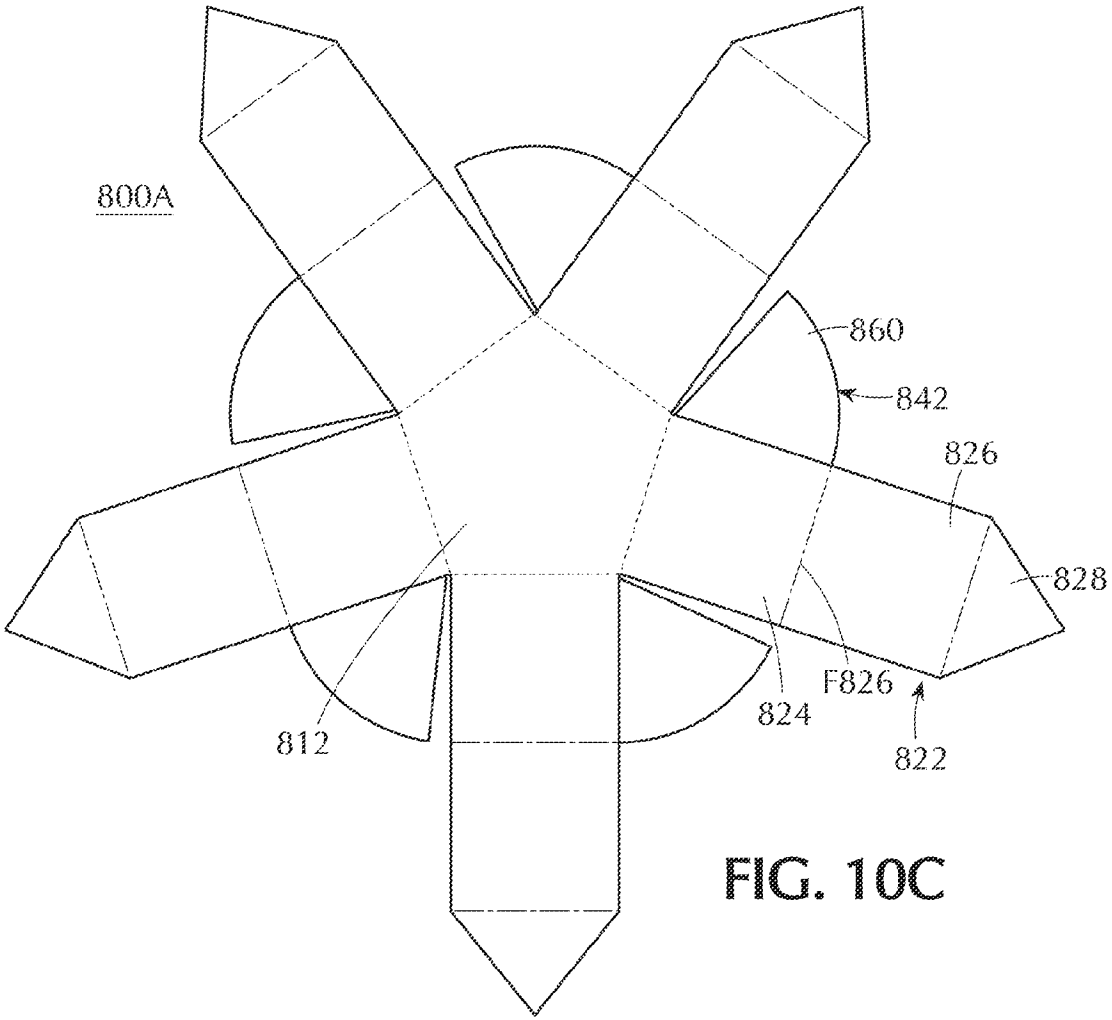
Figure 10E:
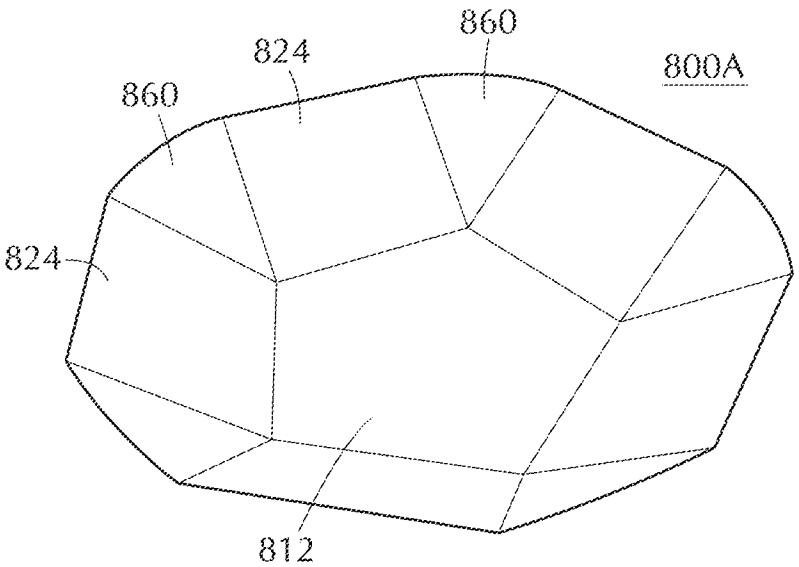
FIG. 10E is a perspective view of an exemplary box in a partially spread form according to some embodiments.
Figure 10D:
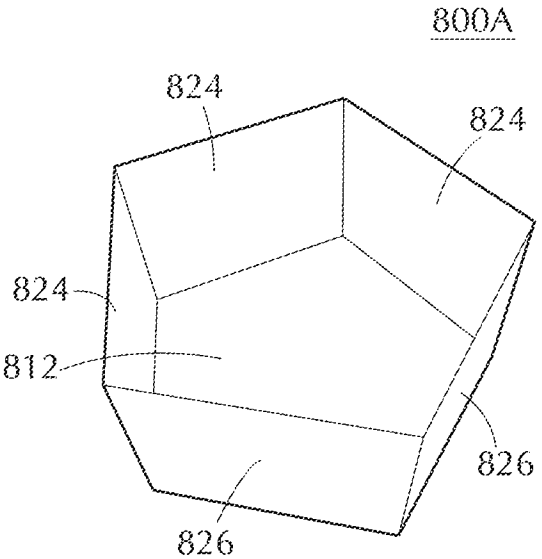
FIG. 10D is a perspective view of an exemplary box in an assembled form according to some embodiments.

FIGS. 10A and 10B illustrate exemplary members for a box 800A shown in FIGS. 10C through 10E. Specifically, FIG. 10A shows a first sidewall member 820 including a first bottom plane 812 and a plurality of first sidewall portions 822. The first bottom plane 812 has a pentagon surface. The plurality of first sidewall portions 822 may be extended from edges of the first bottom plane 812. In FIG. 10A, the first sidewall member 820 includes five first sidewall portions 822 extending from five edges of the first bottom plane 812 in a radial direction.

Each of the first sidewall portions 822 includes a pair of sidewall planes 824 and 826 foldable to overlie each other with a space therebetween. And, each of the first sidewall portions 822 includes a fixing plane 828 integrally connected to an edge of the sidewall plane 826. The fixing plane 828 is located at an end part of the first sidewall portions 822. The fixing plane 828 is foldable to overlie the first bottom plane 812 to be fixed under the backside of the first bottom plane 812.

FIG. 10B shows a second sidewall member 840 including a second bottom plane 814 and a plurality of second sidewall portions 842. The second bottom plane 814 has the same shape as the first bottom plane 812. In FIG. 10B, the second bottom plane 814 has a pentagon surface. The plurality of second sidewall portions 842 may be extended five edges of the second bottom plane 814. In FIG. 10B, the second sidewall member 840 includes five second sidewall portions 842 extended from five edges of the second bottom plane 814 in a radial direction.

Each of the second sidewall portions 842 includes a sidewall plane 844. A plurality of support tabs 860 are protruded from an edge of each of the sidewall planes 844. In other words, in FIG. 10B, one of the support tabs 860 is protruded from one side of the sidewall plane 844.

Referring to FIG. 10C, the first bottom plane 812 of the first sidewall member 820 overlies a front surface of the second bottom plane 814 so that the backside of the first bottom plane 812 is faced with the front surface of the second bottom plane 814, while covering the sidewall planes 844 by the sidewall planes 824 of the first sidewall portions 822.

The sidewall planes 826 is folded down along a folding line F826 to form spaces between the sidewall planes 824 and 826, and the support tabs 860 are inserted into or withdrawn from spaces in order to secure the box 800A in an assembled form or a spread form.

FIG. 10D illustrates the box 800A in its assembled form. Referring to FIG. 10E, the box 800A is secured in a partially spread form by partially withdrawing the support tabs 860 from the spaces formed by the sidewall planes 824 and 826 of the first sidewall portions 822 to convert the box 800A into a bowl type container.

Figure 11:
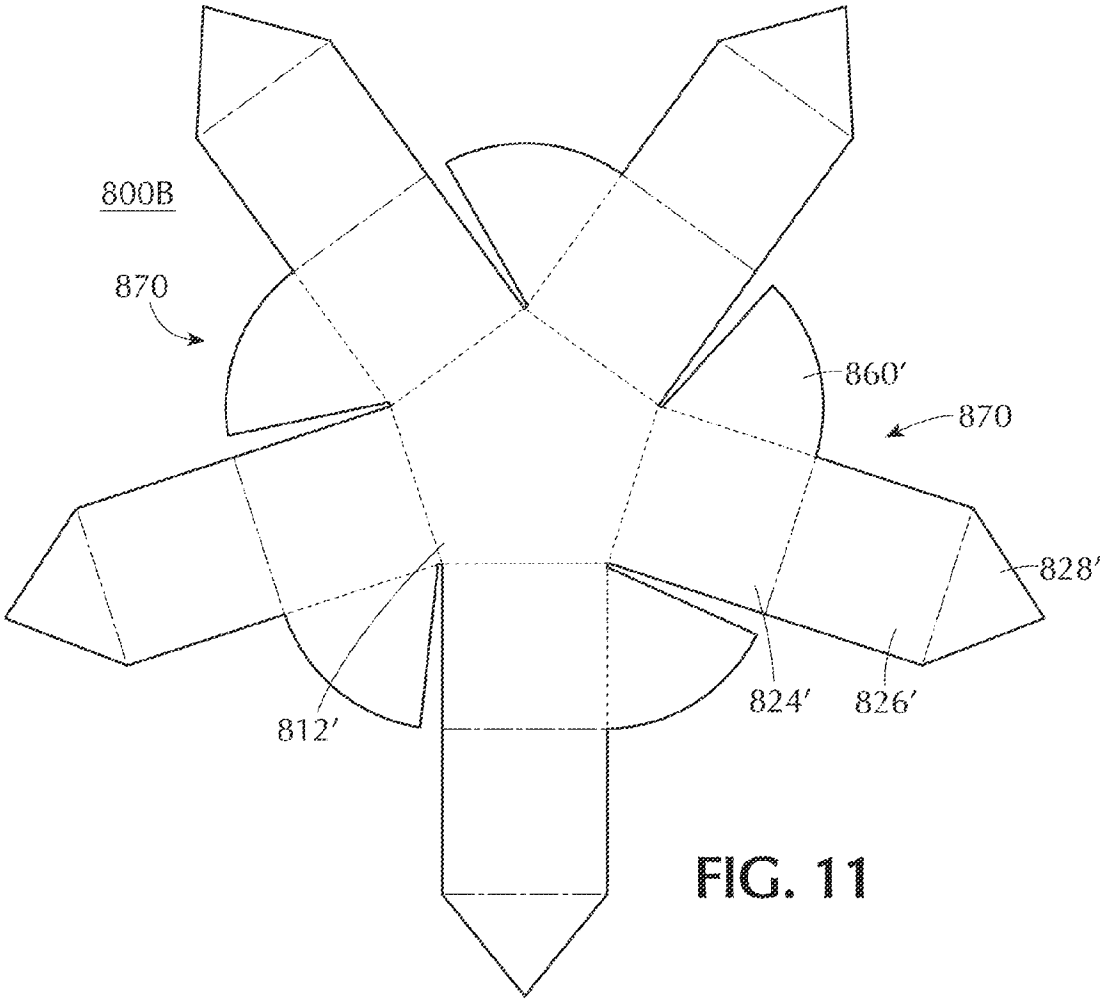
FIG. 11 is a top view of an exemplary box expanded out according to some embodiments.

Referring to FIG. 11, a box 800B is expanded in a blank form useful for forming a spreadable box according to some embodiments. The box 800B has the same contour and same configuration as the box 800A in FIG. 10C excepting the followings.

The box 800B includes a bottom plane 812' and a plurality of sidewall portions 870 extended from edges of the bottom plane 812' in a radial direction. Each of the sidewall portions 870 includes a pair of sidewall planes 824' and 826' foldable to overlie each other with a space therebetween. And, each of the sidewall portions 870 includes a fixing plane 828' integrally connected to an edge of the sidewall plane 826.' The fixing plane 828' is foldable to overlie the bottom plane 812' to be fixed under the backside of the bottom plane 812'. A plurality of support tabs 860' are integrally connected to an edge of the sidewall planes 824'. In FIG. 11, one of the support tabs 860' is protruded from one side of the sidewall plane 824.'

Figure 12A:
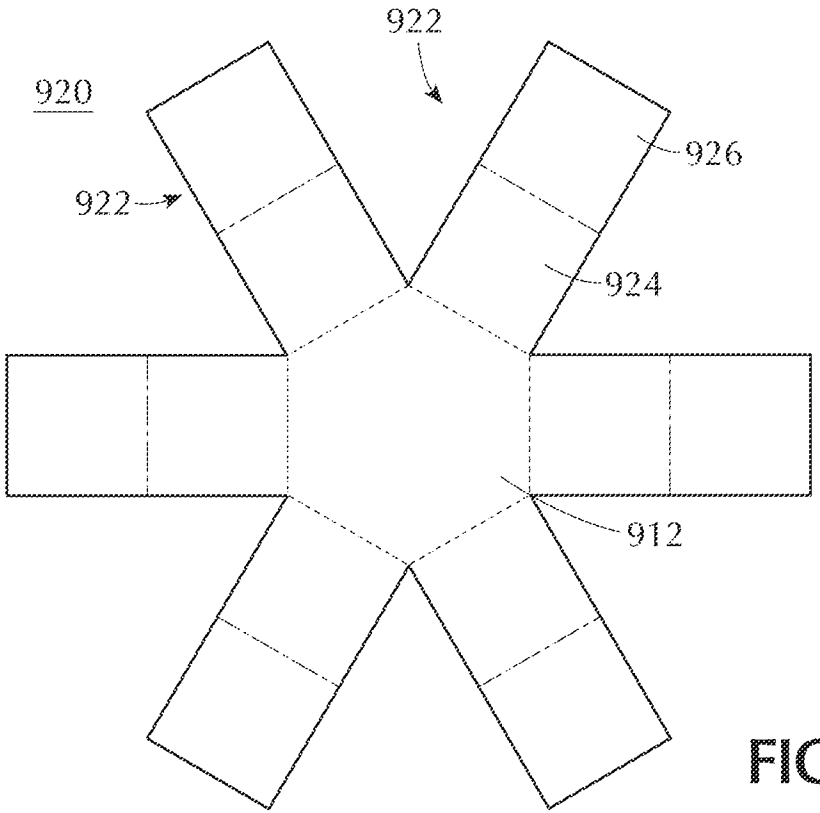
FIGS. 12A through 12C are top views of members for an exemplary box according to some embodiments.
Figure 12B:
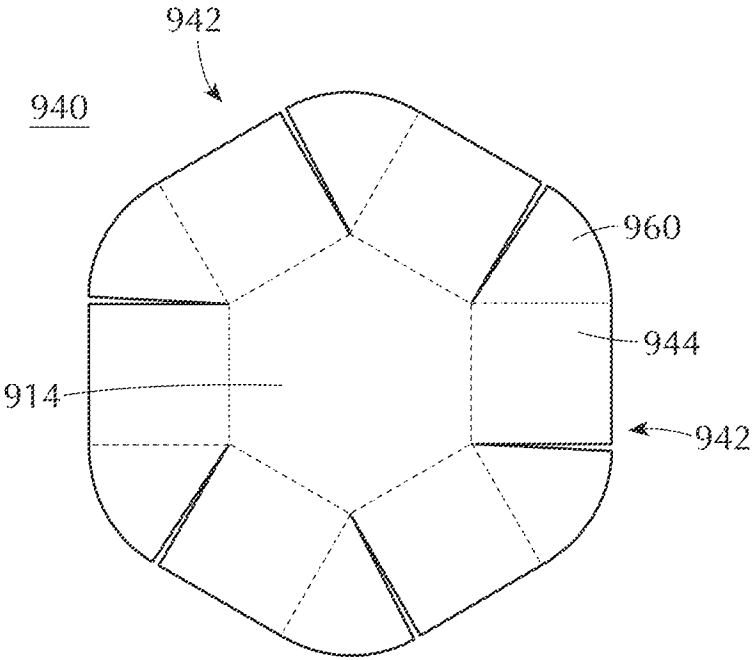
Figure 12C:
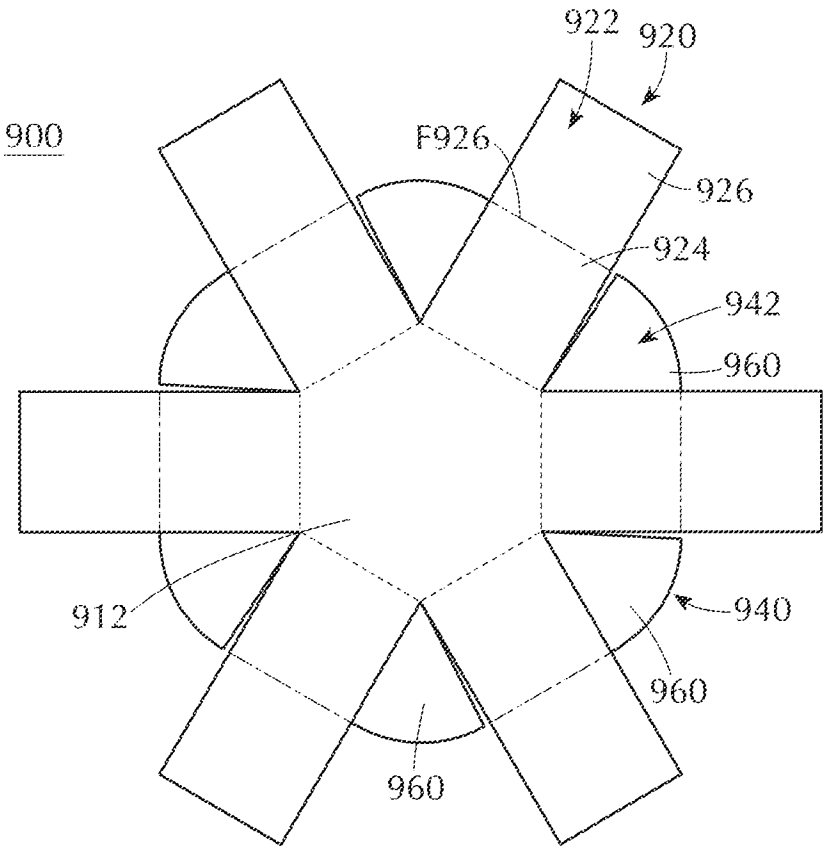

FIGS. 12A and 12B illustrate exemplary members for a box 900 shown in FIG. 12C. Specifically, FIG. 12A shows a first sidewall member 920 including a first bottom plane 912 and a plurality of first sidewall portions 922. The first bottom plane 912 has a hexagon surface. The plurality of first sidewall portions 922 may be extended from edges of the first bottom plane 912. In FIG. 12A, the first sidewall member 920 includes six first sidewall portions 922 extending from six edges of the first bottom plane 912 in a radial direction. Each of the first sidewall portions 922 includes a pair of sidewall planes 924 and 926 foldable to overlie each other with a space therebetween.

FIG. 12B shows a second sidewall member 940 including a second bottom plane 914 and a plurality of second sidewall portions 942. The second bottom plane 914 has the same shape as the first bottom plane 912. In FIG. 12B, the second bottom plane 914 has a hexagon surface. The plurality of second sidewall portions 942 is extended six edges of the second bottom plane 914. In FIG. 12B, the second sidewall member 940 includes six second sidewall portions 942 extended from six edges of the second bottom plane 914 in a radial direction.

Each of the second sidewall portions 942 includes a sidewall plane 944. A plurality of support tabs 960 are protruded from an edge of each of the sidewall planes 944. In FIG. 12B, one of the support tabs 960 is protruded from one side of the sidewall plane 944.

Referring to FIG. 12C, the first bottom plane 912 of the first sidewall member 920 overlies a front surface of the second bottom plane 914 so that the backside of the first bottom plane 912 is faced with the front surface of the second bottom plane 914, while covering the sidewall planes 944 by the sidewall planes 924 of the first sidewall portions 922. The backside of the first bottom plane 912 may be adhered to the front surface of the second bottom plane 914.

The sidewall planes 926 are folded down along a folding line F926, and the backsides of the sidewall planes 926 may be adhered to the backside of the sidewall plane 944 of the second sidewall portions 942. And, the support tabs 960 are inserted into or withdrawn from spaces formed between the backsides of the sidewall planes 924 and the backsides of the sidewall planes 926 of the first sidewall portions 922, in order to secure the box 900 in an assembled form or a spread form.

Figure 13B:
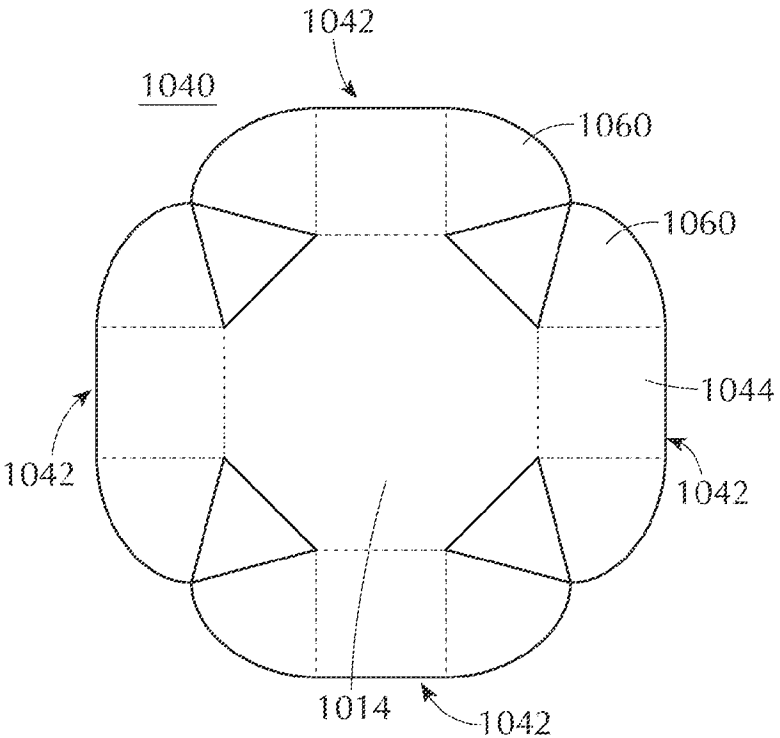
FIGS. 13A and 13B are top views of members for an exemplary box according to some embodiments.
Figure 13A:
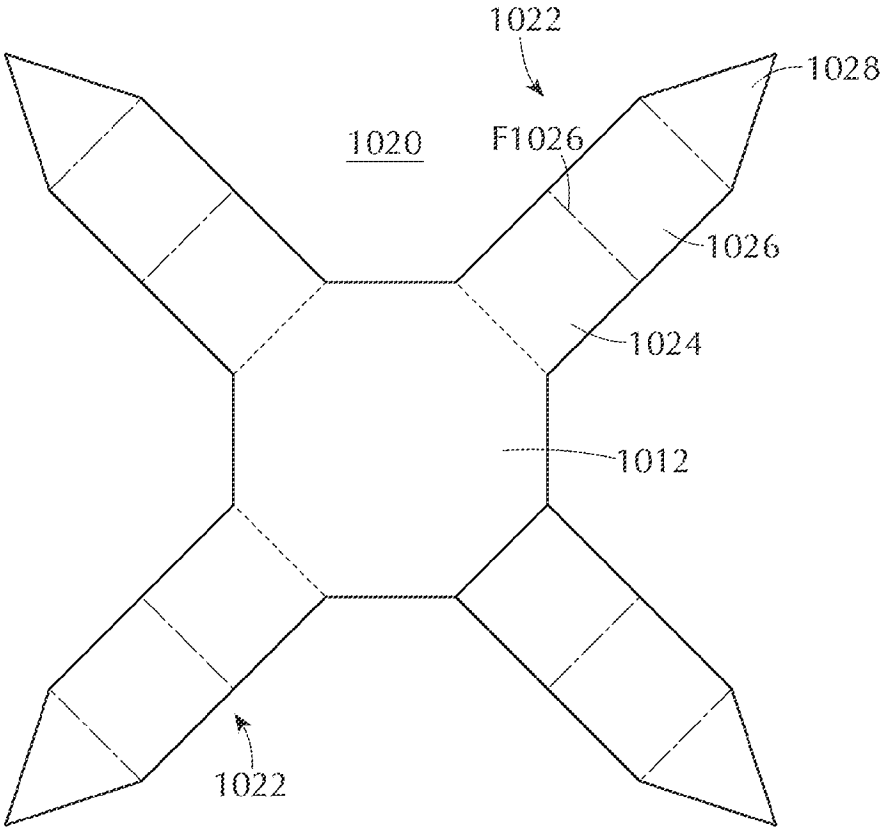
Figure 13D:
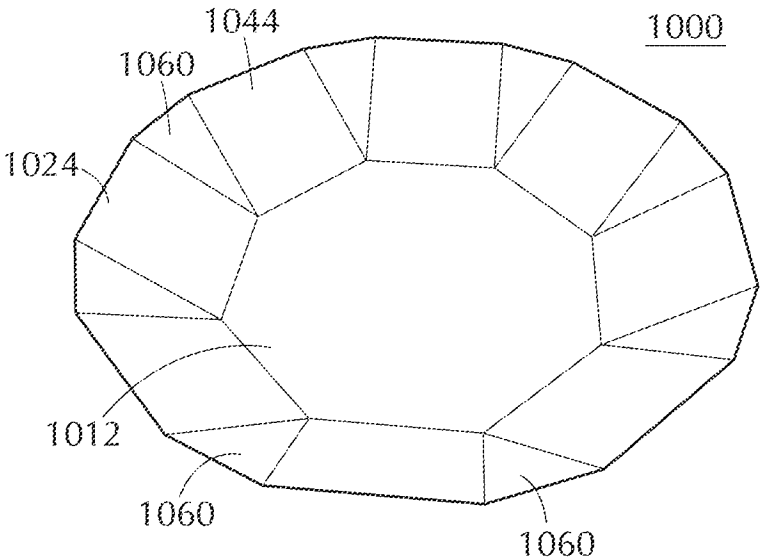
FIG. 13D is a perspective view of an exemplary box in a partially spread form according to some embodiments.
Figure 13C:
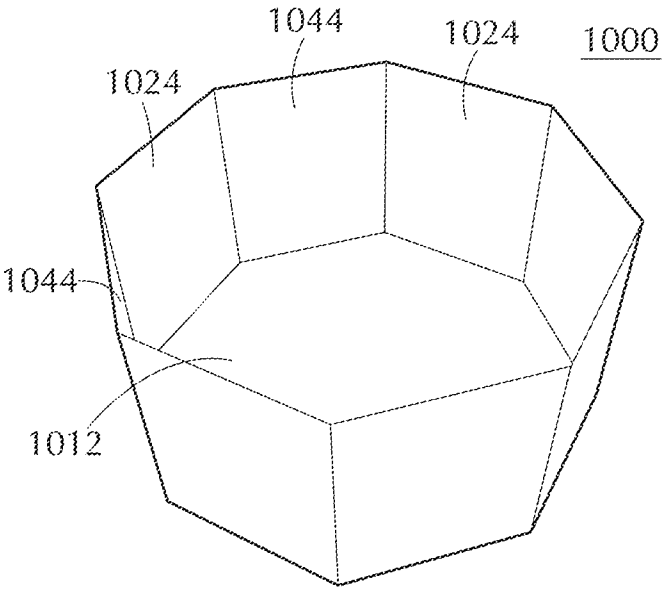
FIG. 13C is a perspective view of an exemplary box in an assembled form according to some embodiments.

FIGS. 13A and 13B illustrate exemplary members for a box 1000 shown in FIGS. 13C and 13D. Specifically, FIG. 13A shows a first sidewall member 1020 including a first bottom plane 1012 and a plurality of first sidewall portions 1022. The first bottom plane 1012 has an octagon surface. The plurality of first sidewall portions 1022 is extended from edges of the first bottom plane 1012. In FIG. 13A, four first sidewall portions 1022 are extended from every other edge among eight edges of the first bottom plane 1012 in a radial direction.

Each of the first sidewall portions 1022 includes a pair of sidewall planes 1024 and 1026 foldable to overlie each other with a space therebetween. And, each of the first sidewall portions 1022 includes a fixing plane 1028 integrally connected to an edge of the sidewall plane 1026. The fixing plane 1028 is located at an end part of each of the first sidewall portions 1022. The fixing plane 1028 is foldable to overlie the first bottom plane 1012 to be fixed under the backside of the first bottom plane 1012.

FIG. 13B shows a second sidewall member 1040 including a second bottom plane 1014 and a plurality of second sidewall portions 1042. The second bottom plane 1014 has the same shape as the first bottom plane 1012. In FIG. 13B, the second bottom plane 1014 has an octagon surface. The plurality of second sidewall portions 1042 is extended from edges of the second bottom plane 1014. In FIG. 13B, the second sidewall member 1040 includes four second sidewall portions 1042 extended from every other edge among eight edges of the second bottom plane 1014 in a radial direction.

Each of the second sidewall portions 1042 includes a sidewall plane 1044. A plurality of support tabs 1060 are protruded from an edge of each of the sidewall planes 1044. In FIG. 13B, the support tabs 1060 are protruded from both sides of the sidewall plane 1044.

The backside of the first bottom plane 1012 of the first sidewall member 1020 overlies a front surface of the second bottom plane 1014 of the second sidewall member 1040 and adhere thereto. Each of the first sidewall portions 1022 of the first sidewall member 1020 is alternatively arranged with each of the second sidewall portions 1042 of the second sidewall member 1040 around the first bottom plane 1012.

The pair of sidewall planes 1024 and 1026 of the first sidewall member 1020 are folded down along a folding line F1026 to form the space therebetween, and neighboring two support tabs 1060 are inserted into or withdrawn from the space in order to secure the box 1000 in an assembled form or a spread form.

FIG. 13C illustrates the box 1000 in its assembled form. Referring to FIG. 13D, the box 1000 is secured in a partially spread form by partially withdrawing the support tabs 1060 from the spaces formed by the first sidewall member 1020 to convert the box 1000 into a bowl type container.

Figure 14A:
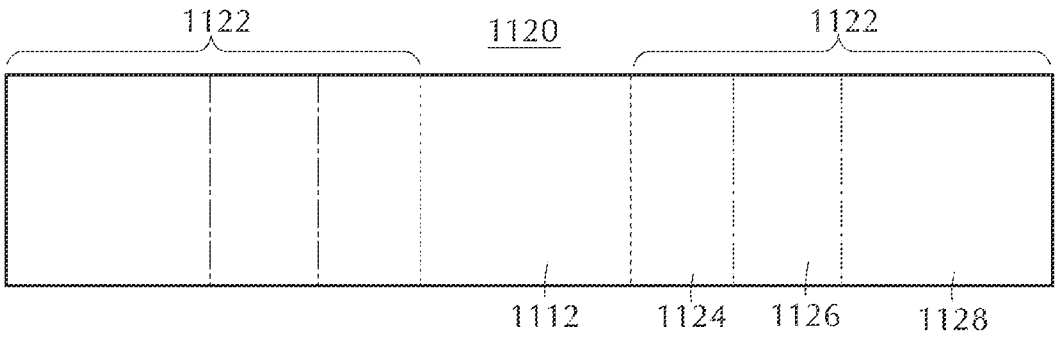
FIGS. 14A through 14C are top views of members for an exemplary box according to some embodiments.
Figure 14B:
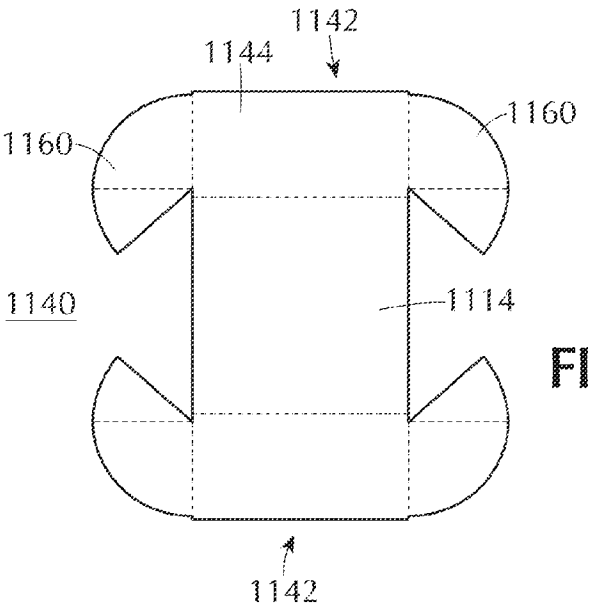
Figure 14C:
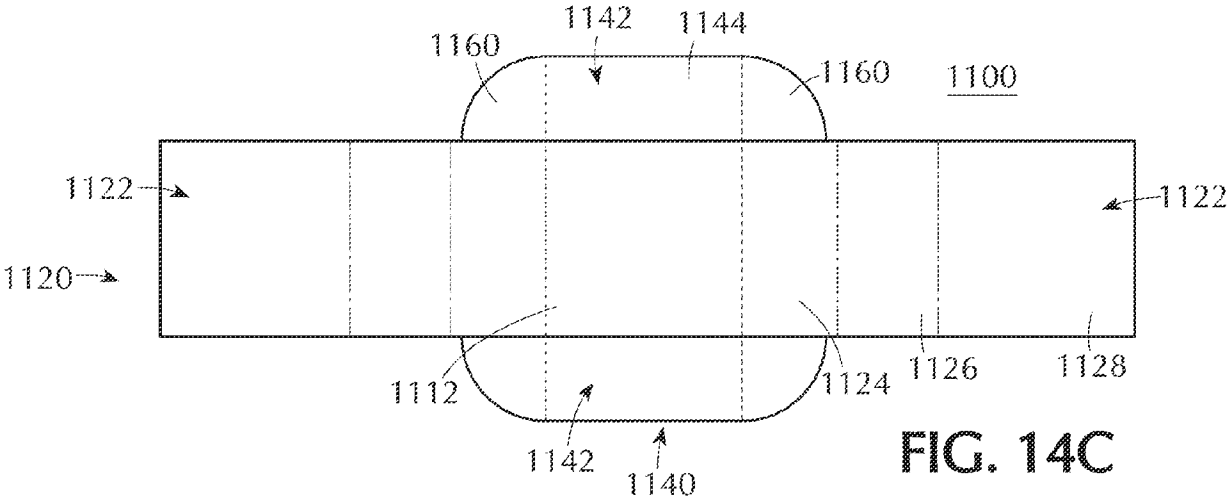

FIGS. 14A and 14B illustrate exemplary members for a box 1100 shown in FIG. 14C. Specifically, FIG. 14A shows a first sidewall member 1120 including a first bottom plane 1112 and a pair of first sidewall portions 1122. The first bottom plane 1112 has a rectangular surface. The first sidewall portions 1122 are extended from both ends of the first bottom plane 1112.

Each of the first sidewall portions 1122 includes a pair of sidewall planes 1124 and 1126 foldable to overlie each other with a space therebetween. And, each of the first sidewall portions 1122 includes a fixing plane 1128 integrally connected to an edge of the sidewall plane 1126. The fixing plane 1128 is foldable down to overlie the first bottom plane 1112 and fixable to the backside of the first bottom plane 1112.

FIG. 14B shows a second sidewall member 1140 including a second bottom plane 1114 and a pair of second sidewall portions 1142. The second bottom plane 1114 has the same shape as the first bottom plane 1112. In FIG. 14B, the second bottom plane 1114 has a rectangular surface. The second sidewall portions 1142 are extended from both ends of the second bottom plane 1114.

The second sidewall portions 1142 include a sidewall plane 1144. A pair of support tabs 1160 are protruded from both sides of each of the sidewall planes 1144. Here, each of the support tabs 1160 have curved edges, each of which provides a rounded outermost edge of the box 1100 when the box 1100 is in its spread form. Each of the support tabs 1160 has a shape of a fan having an obtuse central angle.

Referring to FIG. 14C, the first bottom plane 1112 of the first sidewall member 1120 overlies a front surface of the second bottom plane 1114 so that the backside of the first bottom plane 1112 is faced with the front surface of the second bottom plane 1114. The first sidewall portions 1122 of the first sidewall member 1120 are alternatively arranged with each of the second sidewall portions 1142 of the second sidewall member 1140 around the first bottom plane 1112. In this state, portions of each support tabs 1160 are covered by the sidewall planes 1124 because each of the support tabs 1160 has a shape of a fan having an obtuse central angle.

In order to assemble the box 1100, the pair of sidewall planes 1124 and 1126 of the first sidewall member 1120 are folded down to form the space therebetween, and then the fixing planes 1128 are folded down to fix to the backside of the first bottom plane 1112. Thereafter, the sidewall planes 1124 and 1144 are folded up to stand upright while inserting the support tabs 1160 into the space formed by the pair of sidewall planes 1124 and 1126. When sidewall planes 1124 and 1144 are folded up to stand upright to secure the box 1100 in an assembled form, portions of each support tabs 1160 become interposed between the backside of the first bottom plane 1112 and the front surface of the second bottom plane 1114 because of the obtuse central angel of the support tabs 1160.

In order to convert the box 1100 into a dish type container by spreading out the box 1100, the support tabs 1160 are withdrawn from the space while folding back the sidewall planes 1124 and 1144. Even in a state where the sidewall planes 1124 and 1144 keep horizontal and the box 1100 is completely spread out, portions of each support tabs 1160 remain interposed between the backside of the first bottom plane 1112 and the front surface of the second bottom plane 1114 within the space formed by the pair of sidewall planes 1124 and 1126. Therefore, it is possible to prevent contents in the box 1100 from being escaped though the box 1100 when the box 1100 is used as a container for accommodating food.

According to some embodiments, the boxes 100, 200, 300, 400, 500, 600, 700, 800, 900, 1000 and 1100 may further include an inner liner covering its bottom portion and sidewall portions.

Figure 15:
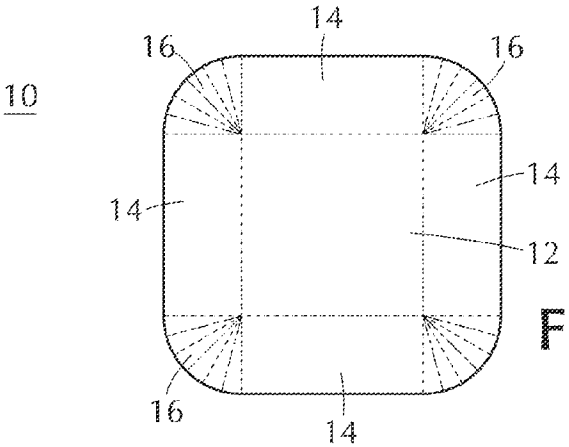
FIG. 15 is a top view of inner liner of an exemplary box according to some embodiments.

Referring to FIG. 15, an inner liner 10 includes a bottom portion 12 for covering the bottom portion of the box according to some embodiments. The inner liner 10 further includes a plurality of sidewalls 14 for covering sidewall portions of the box according to some embodiments. The inner liner 10 sill further includes a plurality of ruffled portions 16 for covering the support tabs of the box according to some embodiments when the box is in a spread form. The ruffled portions 16 have at least one crease for folding up or folding down. The ruffled portions 16 may be contracted or expanded according to the assembled state or spread state of the box.

The inner liner 10 may be made of any pliable material such as paper, plastic, or aluminum foil.

Each of the boxes according to the aforementioned embodiments is suitable for forming a relatively large box for holding a relatively large or heavy article such as household electric appliance, and may be configured to accommodate the article. In the boxes according to the aforementioned embodiments, the support tabs may be withdrawn from the spaces between the sidewall planes when the article needs to be removed from the box. As a result, the opening of the box would become larger than the bottom, thus removing the article is more convenient. And, each of the boxes according to the aforementioned embodiments may be changed from its assembled form into convenient serving plate. Therefore, it is possible to eliminate the need for preparation of dishes or disposable plates.

While the inventive concept has been particularly shown and described with reference to example embodiments thereof, it will be understood that various changes in form and details may be made therein without departing from the spirit and scope of the following claims.

What is claimed is:

1. A spreadable box, comprising:

a bottom portion including at least one bottom plane;

a plurality of sidewall portions extending from the bottom portion, wherein at least one of the plurality of sidewall portions includes a pair of sidewall planes folded to overlie each other, thereby forming a space therebetween; and at least one support tab protruded from at least one of the plurality of sidewall portions and configured to be inserted into or withdrawn from the space in order to secure the box in an assembled form or a spread form, wherein the at least one bottom plane includes a first bottom plane and a second bottom plane, one of the first or second bottom planes overlying the other of the first or second bottom planes, the plurality of sidewall portions includes a plurality of first sidewall portions extending from the first bottom plane, and a plurality of second sidewall portions extending from the second bottom plane, each of the plurality of first sidewall portions includes the pair of sidewall planes folded to overlie each other with the space therebetween, the at least one support tab includes a plurality of support tabs each of which is protruded from an edge of one of the plurality of second sidewall portions, and at least one of plurality of first sidewall portions has a fixing plane located at an end part of the first sidewall portion and folded to overlie the first and second bottom planes and fix the fixing plane to the first or second bottom planes.

2. The spreadable box of claim 1, wherein the plurality of support tabs includes a first support tab and a second support tab protruded from one of the plurality of second sidewall portions in opposite directions to each other.

3. The spreadable box of claim 1, wherein the plurality of support tabs includes a plurality of one-side support tabs each of which is protruded from an edge of one of the plurality of second sidewall portions and configured to be inserted into or withdrawn from the space formed by the pair of sidewall planes of the plurality of first sidewall portions in order to secure the box in an assembled form or a spread form.

4. The spreadable box of claim 1, further comprising a plurality of support tabs including the at least one support tab, and a connection positioned within the space formed by the pair of the sidewall planes for connecting neighboring two support tabs selected from the plurality of support tabs through the space, the neighboring two support tabs being inserted into or withdrawn from the space.

5. A spreadable box, comprising:

a bottom portion including at least one bottom plane;

a plurality of sidewall portions extending from the bottom portion, wherein at least one of the plurality of sidewall portions includes a pair of sidewall planes folded to overlie each other, thereby forming a space therebetween; and at least one support tab protruded from at least one of the plurality of sidewall portions and configured to be inserted into or withdrawn from the space in order to secure the box in an assembled form or a spread form, wherein the at least one bottom plane includes a first bottom plane and a second bottom plane, one of the first or second bottom planes overlying the other of the first or second bottom planes, the plurality of sidewall portions includes a plurality of first sidewall portions extending from the first bottom plane, and a plurality of second sidewall portions extending from the second bottom plane, each of the plurality of first sidewall portions includes the pair of sidewall planes folded to overlie each other with the space therebetween, the at least one support tab includes a plurality of support tabs each of which is protruded from an edge of one of the plurality of second sidewall portions, and the spreadable box further comprises:

an inner wall member having a third bottom plane interposed between the first bottom plane and the second bottom plane; and a plurality of third sidewall portions extended from the third bottom plane and interposed between neighboring two support tabs within the space formed by the pair of sidewall planes to separate the space into two paths through each of which one of the neighboring two support tabs is moved.

* * * * *